US006568134B2

(12) United States Patent
Kerney

(10) Patent No.: US 6,568,134 B2
(45) Date of Patent: May 27, 2003

(54) COMPONENTIZED, THREE DIMENSIONAL, SELF-ALIGNING, SELF-ENGINEERING BUILDING SYSTEM FOR HOMES, AND MODELING BLOCKS THEREFOR

(76) Inventor: Thomas E. Kerney, 5852 Orebank Rd., Kingsport, TN (US) 37664

( * ) Notice: Subject to any disclaimer, the term of this patent is extended or adjusted under 35 U.S.C. 154(b) by 0 days.

(21) Appl. No.: 09/910,166

(22) Filed: Jul. 20, 2001

(65) Prior Publication Data

US 2003/0014928 A1 Jan. 23, 2003

(51) Int. Cl.[7] ..... E04B 7/04; E04B 7/02; E04B 1/32; E04H 12/00

(52) U.S. Cl. ..... 52/90.1; 52/93.1; 52/637; 52/643; 52/648.1

(58) Field of Search ..... 52/90.1, 93.1, 52/634, 637, 638, 639, 641, 643, 648.1, 650.1

(56) References Cited

U.S. PATENT DOCUMENTS 3,184,012 A * 5/1965 Fujishima
3,651,612 A * 3/1972 Schmitt ..... 52/642
3,817,438 A * 6/1974 Raab ..... 227/152
4,295,318 A * 10/1981 Perlman ..... 411/467
4,483,117 A * 11/1984 Underhill et al. ..... 52/639
4,616,452 A * 10/1986 Lemerre ..... 52/302.3
4,656,792 A * 4/1987 Clark ..... 52/642
5,341,611 A * 8/1994 Lewis ..... 52/643
5,592,800 A * 1/1997 Koo et al. ..... 52/692
6,052,953 A * 4/2000 Jewell ..... 52/639
6,212,850 B1 * 4/2001 Branson ..... 119/437

* cited by examiner

*Primary Examiner*—Carl D. Friedman
*Assistant Examiner*—Kevin McDermott
(74) *Attorney, Agent, or Firm*—Malcolm G. Dunn

(57) ABSTRACT

A componentized, three dimensional, self-aligning, self-engineering building system for homes and similar constructions involving a plurality of individual, separately installable components of predetermined height selectively arranged, positioned and secured to each other in side-by-side relationship along the perimeter of and also secured on a previously prepared flat supporting surface for a home; and modeling blocks representing the components.

12 Claims, 20 Drawing Sheets

FIG. 9
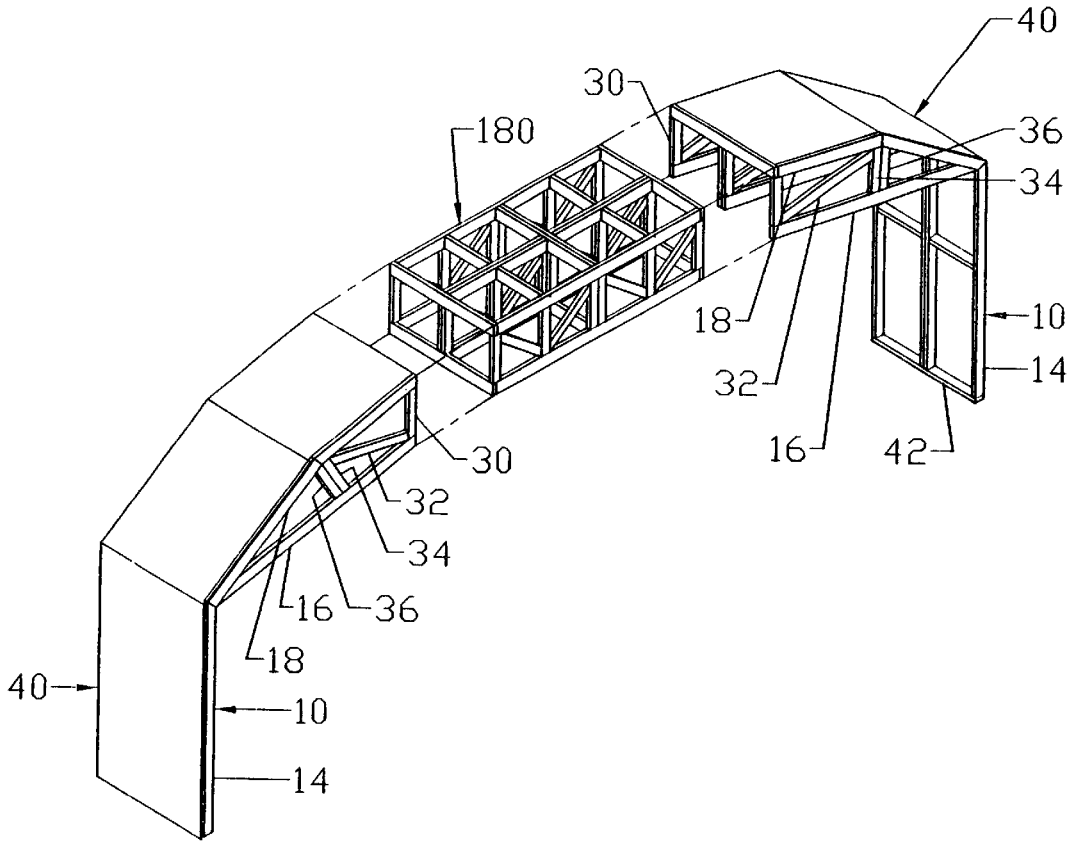
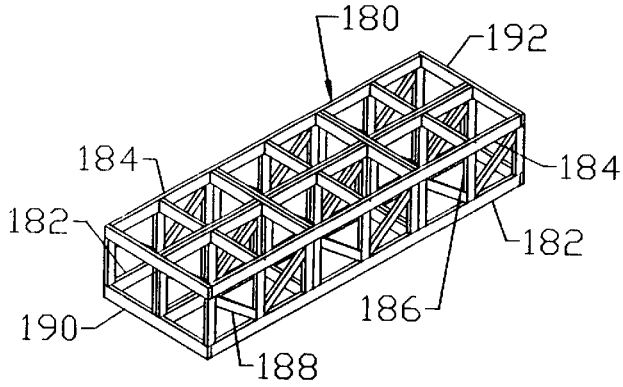
FIG. 8

COMPONENTIZED, THREE DIMENSIONAL, SELF-ALIGNING, SELF-ENGINEERING BUILDING SYSTEM FOR HOMES, AND MODELING BLOCKS THEREFOR

CROSS-REFERENCE TO RELATED APPLICATIONS

Not Applicable

REFERENCE TO A MICROFICHE

Not Applicable

BACKGROUND OF THE INVENTION

In building a home, the design plans for what the home will look like are usually prepared by someone having architectural experience and engineering skills. The location where the home is to be erected is suitably prepared first by the establishment of an adequate and properly installed foundation, which is, of course, essential to all types of wood structures or for that matter, to any other structure. The home is erected in accordance with the architectural plans, usually by persons with some carpenter skills and experience.

The average layman usually does not have architectural experience or engineering skills to be able to design a home, and usually does not have the skills of an experienced carpenter to be able to erect a home. A home represents one of the most significant investments that one can make in his or her life time; therefore, it behooves one to assure that the design and erection of the home is professionally done to justify this significant investment.

One of the objects of the present invention is to provide a series of differently designed components, which have the same uniform height and which may be selectively arranged, positioned and aligned in side-by-side relationship for constructing a home.

Another object of the present invention is to provide a series of differently designed components, which are pre-engineered to meet national, state and local building standards in building a home for a life-time of trouble-free structural durability.

Still another object of the present invention is to provide a componentized, 3-dimensional, self-aligning, self-engineering building system that will make it possible even for an average layperson, at least for one willing to attempt it, to lay out a design of a home that will meet his/her needs and that will be sufficiently appealing in accordance with his/her wishes as to the appearance the home should have.

A further object of the present invention is to provide separately designed components, in the manner described above, which may be made available through any local building supply company for ready selection by the individual homeowner-to-be or by a home building contractor in accordance with his/her requirements, and which may be easily loaded, carried away and positioned on a previously prepared site foundation without the necessity of using heavy equipment.

A still further object of the present invention is to provide separately designed components, in the manner described above, which may be aligned and connected in side-by-side relationship on a flat surface at the manufacturing site to form sections of a home that may be separately moved to a building site and aligned and assembled with other sections to form a home in accordance with the expectations and wishes of the homeowner-to-be.

BRIEF SUMMARY OF THE INVENTION

The present invention, therefore, is directed to a componentized, three dimensional, self-aligning, self-engineering building system for homes and similar constructions having a plurality of individual, separately installable components of predetermined width and of the same predetermined height, which are selectively arranged, positioned and secured to each other in side-by-side relationship along the perimeter of and also secured on a previously prepared flat supporting surface. Each component defines at least one load-bearing vertical wall section having a lower end adapted to engage and to be secured to the flat supporting surface, and an upper end; and an inclined roof truss section comprising a series of multiple polygon configurated reinforcements connected together in side-by-side relationships having a lower end joined to the upper end of the vertical wall section to form an integrally constructed connected unit, and having an upper end, and which defines on each side thereof a plane of intersection with the roof truss section of an adjacent component.

One of the plurality of components has an inclined roof truss section that is defined by two three-sided planes each intersecting the other along a corresponding side thereof at an angle that is less than 180 degrees, as measured from the upper side of the inclined roof truss section.

Another of the plurality of components has an inclined roof truss section that is defined by two three-sided planes each intersecting the other along a corresponding side thereof at an angle that is greater than 180 degrees, as measured from the upper side of the inclined roof truss section.

In the componentized three dimensional self-aligning, self-engineering building system, each component has multiple ribs, which are connected together in spaced, parallel relationship as a single unit. Each rib defines a vertical member of the load-bearing vertical wall section having a predetermined length and a lower end adapted to engage the flat supporting surface, and an upper end; and an inclined lower chord member having a predetermined length and an inclined upper chord member having a predetermined length and overlying the inclined lower chord member in paired relationship. The inclined lower and inclined upper chord members are connected at their respective lower ends to the upper end of the vertical member, and are connected at their respective upper ends to form part of the series of multiple polygon configurated reinforcements in the aforementioned inclined roof truss section.

One of the components has a left rib and a right rib connected together in parallel relationship. The left rib and the right rib each has a primary vertical member of the load-bearing vertical wall section having a predetermined length and a lower end adapted to engage the flat supporting surface, and an upper end; and a primary inclined lower chord member having a predetermined length and a primary inclined upper chord member having a predetermined length and overlying the primary inclined lower chord member in paired relationship. The primary inclined lower and primary inclined upper chords are connected at their respective lower ends to the upper end of the primary vertical member and are connected at their respective upper ends to form part of the series of multiple polygon configurated reinforcements in the inclined roof truss section. The left rib and the right rib each includes a plurality of secondary inclined lower chord members having predetermined lengths and a plurality of secondary inclined upper chord members having predetermined lengths. Each secondary inclined upper chord member overlies a respective secondary inclined lower chord member in paired relationship. The secondary inclined lower and the secondary inclined upper chord members are connected at their respective lower ends, respectively, to and spaced at intervals along and inclined outwardly from the primary inclined lower chord member and the primary inclined upper chord member, and are connected at their upper ends to form part of the series of multiple polygon configurated reinforcements in the inclined roof truss section. The secondary inclined lower chord members and the secondary inclined upper chord members in the aforementioned paired relationships of the left rib and the right rib each have different predetermined lengths than adjacent secondary inclined lower and upper chord members for the same rib.

In one of the components, each component has a left rib and a right rib connected together in parallel relationship. The left rib and the right rib each has a primary vertical member of the aforementioned load-bearing vertical wall section and has a predetermined length and a lower end adapted to engage the flat supporting surface, and an upper end; and a primary inclined lower chord member having a predetermined length and a primary inclined upper chord member having a predetermined length and overlying the primary inclined lower chord member in paired relationship and connected at their respective lower ends to the upper end of the primary vertical member and connected at their respective upper ends to form part of the series of multiple polygon configurated reinforcements in the inclined roof truss section. The left rib and the right rib each includes at spaced parallel intervals therefrom a plurality of secondary vertical members of the load-bearing vertical wall section having the same predetermined lengths and each having a lower end adapted to engage the aforementioned flat supporting surface, and an upper end; and a plurality of secondary inclined lower chord members having predetermined lengths and a plurality of secondary inclined upper chord members having predetermined lengths and each overlying a respective secondary inclined lower chord member in paired relationship, and connected, respectively, at their respective upper ends to and spaced at intervals along and inclined outwardly from the primary inclined lower chord member and the primary inclined upper chord member and connected at their lower ends to a respective upper end of a secondary vertical member to form part of the series of multiple polygon configurated reinforcement in the inclined roof truss section. The secondary inclined lower chord members and the secondary inclined upper chord members in the aforementioned paired relationships each have different predetermined lengths than adjacent secondary inclined lower and secondary inclined upper chord members for the same rib.

The componentized three dimensional self-aligning, self-engineering building system further includes flat truss section components each having pairs of horizontally extending lower chord members and horizontally extending upper chord members each overlying one of the horizontally extending lower chord members in spaced parallel relationship and are connected together in side-by-side spaced, parallel relationship to define a rectangular cross-section having a predetermined width and a predetermined length longer than the aforementioned predetermined width. Each horizontally extending lower chord member and the overlying horizontally extending upper chord member have connected therebetween a series of reinforcing members formed in multiple polygon configurations. Each flat truss section component includes at each end thereof a pair of end members connected, respectively, across the respective ends of each pair of horizontally extending lower and upper chord members in the flat truss section component. In this manner, therefore, each flat truss section component is adapted to engage at each pair of end members and to be connected to an inclined roof truss section of another of the aforementioned components.

The outer horizontally extending lower and upper chord members for each side of the flat truss section component defines a pair of side members adapted to engage and be connected to another component.

Each componentized three dimensional self-aligning, self-engineering building system further includes a flat truss section component having a rectangular cross-section and is adapted to engage at each end thereof and be connected to an inclined roof truss section of one the other aforementioned components.

Each componentized three dimensional self-aligning, self-engineering building system may further have a plurality of flat truss section components positioned in side-by-side relationship and each engaging at each end thereof and being connected to an upper end of an inclined roof truss section of one of the other aforementioned components.

In the componentized three dimensional self-aligning, self-engineering building system, each component may include a left rib and a right rib connected together in parallel relationship. The left rib and the right rib each has a primary vertical member of the aforementioned load-bearing vertical wall section having a predetermined length and having a lower end adapted to engage the aforementioned flat supporting surface, and an upper end; and a primary inclined lower chord member having a predetermined length and a primary inclined upper chord member having a predetermined length and overlying the primary inclined lower chord member in paired relationship and connected at their respective lower ends to the upper end of the primary vertical member and connected at their respective upper ends to form part of the series of multiple polygon configurated reinforcements in the inclined roof truss section. The left rib and the right rib each have a plurality of secondary inclined lower chord members having predetermined lengths and a plurality of secondary inclined upper chord members having predetermined lengths and each overlying a respective secondary inclined lower chord member in paired relationship and connected, respectively, at their respective lower ends to and spaced at intervals along and inclined outwardly from the primary inclined upper chord member and connected at their upper ends to form part of the series of multiple polygon configurated reinforcements.

The componentized three dimensional self-aligning, self-engineering building system may be represented on a smaller scale by modeling blocks, which include the following basic shapes:

a. a rectangular block having a predetermined width and a predetermined length greater than the predetermined width, a flat bottom surface, vertical sides intersecting the flat bottom surface at right angles, and at least one inclined top surface intersecting the vertical sides at right angles, and the rectangular block having the general configuration shown in FIG. 17 of the drawings;

b. a rectangular block having the same predetermined length on each side, a flat bottom surface, vertical sides intersecting the flat bottom surface at right angles, at least one inclined top surface defined by two intersecting triangular plane surfaces having an angle therebetween less than 180 degrees, as measured from the top surface, the two intersecting triangular plane surfaces also intersecting the vertical sides at right angles, and the rectangular block having the general configuration shown in FIG. 18 of the drawings; and c. a rectangular block having the same predetermined length on each side, a flat bottom surface, vertical sides intersecting the flat bottom surface at right angles, at least one inclined top surface defined by two intersecting triangular plane surfaces having an angle therebetween greater than 180 degrees, as measured from the top surface, and two intersecting triangular plane surfaces also intersecting the vertical sides at right angles, and the rectangular block having the general configuration shown in FIG. 19 of the drawings.

The modeling blocks may further include the following block shapes:

a. a rectangular block having the same predetermined length on each side, a flat bottom surface, vertical sides intersecting the flat bottom surface at right angles, a top flat surface intersecting the vertical sides at right angles, and the rectangular block having the general configuration shown in FIG. 20 of the drawings;

b. a rectangular block having a predetermined length and a predetermined width, a flat bottom surface adapted to be positioned on the flat top surface of the rectangular block recited in subparagraph a., a top surface intersecting the flat bottom surface and defined by two intersecting and oppositely facing truncated triangular plane surfaces each intersecting the other along the line of truncation between the truncated triangular plane surfaces at an angle greater than 180 degrees, as measured from the top surface, and each also intersecting along one of its three sides the flat bottom surface, a triangular plane surface located between and intersecting along each of two of its three sides another of the three sides of one of the truncated triangular plane surfaces and also intersecting along its third side the flat bottom surface; the rectangular block further including a triangular side surface intersecting on one of its three sides the flat bottom surface at right angles and intersecting on each of its other two sides the third side of one of the truncated triangular plane surfaces, and the rectangular block having the general configuration shown in FIGS. 21(*a*), 21(*b*) of the drawings;

c. a rectangular block having a predetermined length and a predetermined width, a flat bottom surface adapted to be positioned on the flat top surface of the rectangular block recited in subparagraph a., two triangular plane surfaces each intersecting at one of its three sides the flat bottom surface at right angles, at least two inclined, oppositely facing rectangular flat surfaces each intersecting the other along one of its four sides at an angle greater than 180 degrees, as measured from the top surfaces, the two inclined rectangular flat surfaces each also intersecting along one of two other of its sides one of teach of the triangular planes surfaces and along still another of its four sides the flat bottom surface, and the rectangular block having the general configuration shown in FIG. 22 of the drawings; and d. a triangular block having a predetermined length and a predetermined width, a flat bottom surface adapted to be positioned on one of the truncated triangular plane surfaces of the rectangular block recited in subparagraph b. and on one of the inclined rectangular flat surfaces of the rectangular block recited in subparagraph c., a top surface defined by two oppositely facing inclined triangular plane surfaces each intersecting the other along one of its three sides at greater than 180 degrees, as measured from the top surface, and intersecting along another of its three sides the flat bottom surface, a flat triangular surface inclined from a vertical plane of less than 90 degrees and intersecting along one of its three sides the flat bottom surface and intersecting along each of its other two sides the third side of one of the oppositely facing inclined triangular plane surfaces, and the triangular block having the general configuration shown in FIGS. 23(*a*), 23(*b*) of the drawings.

BRIEF DESCRIPTION OF THE SEVERAL VIEWS OF THE DRAWINGS

FIG. 1(*b*) is an isometric view of a rib illustrating a primary inclined upper chord member having a dual pitch;

FIG. 1(*c*) is an alternate embodiment of the secondary rib shown in FIG. 1(*a*) and illustrates a secondary inclined upper chord member having a single pitch, the reference numbers in the alternate embodiment having prime marks after them to show elements corresponding to elements in the embodiment of FIG. 1(*a*);

FIG. 1(*d*) is an alternate embodiment of the rib shown in FIG. 1(*b*) and illustrates a primary inclined upper chord member having a single pitch, the reference numbers in the alternate embodiment having prime marks after them to show elements corresponding to elements in the embodiment of FIG. 1(*b*);

FIG. 2(*b*) is a view similar to that shown in FIG. 2(*a*), with the exception that the framework shown in FIG. 2(*a*) is illustrated as being mostly covered with panels, and shows that the length along one side of the expansion section component may be 2W and that the width along another side may be W;

FIG. 4(*b*) is a view similar to FIG. 4(*a*), with the exception that the framework shown in FIG. 4(*a*) is illustrated as being mostly covered by panels, and shows that the length along each side of the inside corner component may be 2W;

FIG. 6(*b*) is a view similar to FIG. 6(*a*), with the exception that the framework shown in FIG. 6(*a*) is illustrated as being mostly covered by panels, and shows that the length along each side of the outside corner component may be 2W;

FIG. 8 is an isometric view of a flat truss section component;

FIG. 9 is an isometric exploded view of two oppositely facing expansion section components having dual pitch and a flat truss section component therebetween in preparation for assembly together;

FIG. 16(*b*) is an isometric view of multiple vertical wall sections of FIG. 16(*a*) assembled and joined together on a flat supporting surface (not shown) to illustrate the appearance of part of two vertical walls one intersecting the other at right angles and representing part of the first story above and upon which the components of the invention would be positioned in the next or second story of a home;

FIG. 21(*b*) is an isometric view of the modeling block of FIG. 21(*a*), and illustrating it as being oriented to show the opposite side of this modeling block;

FIG. 23(*b*) is a plan view of the modeling block of FIG. 23(*a*) and illustrating a different orientation of this modeling block;

FIGS. 28 through 33 represent "draw files" of the different components described herein that may be filed in a computer system and retrieved and by use of a computer mouse to assemble the different components on a monitor screen to form different designs of homes, and wherein:

FIG. 28 shows four different orientations for the expansion section component of FIGS. 2(*a*), 2(*b*), 17;

FIG. 29 shows four different orientations for the inside corner component of FIGS. 4(*a*), 4(*b*), 18;

FIG. 30 shows four different orientations for the outside corner component of FIGS. 6(*a*), 6(*b*), 19;

FIG. 31 shows four different orientations for the roof truss hip cap of FIGS. 13, 21(*a*), 21(*b*);

FIG. 32 shows four different orientations for the roof truss expansion cap of FIGS. 14, 22; and FIG. 33 shows four different orientations for the roof truss joiner cap of FIGS. 12, 23(*a*, 23(*b*).

DETAILED DESCRIPTION OF THE INVENTION

Figure 1A:
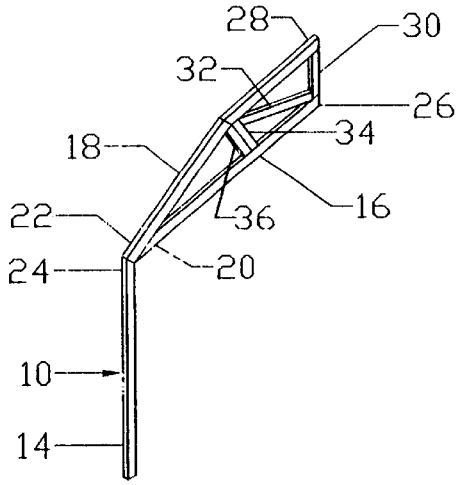
FIG. 1(*a*) is an isometric view of a secondary rib illustrating a secondary inclined upper chord member having a dual pitch.
Figure 1B:
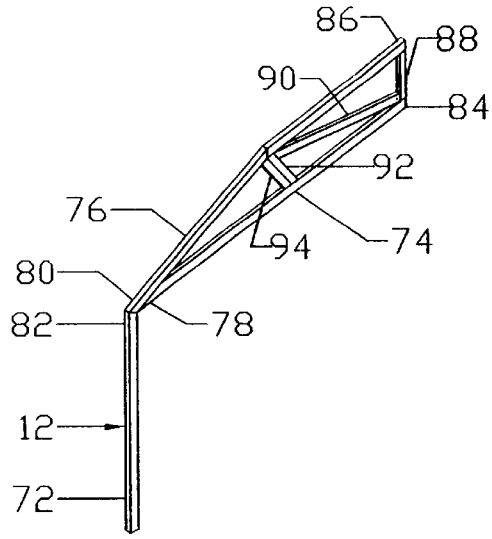
Figure 1C:
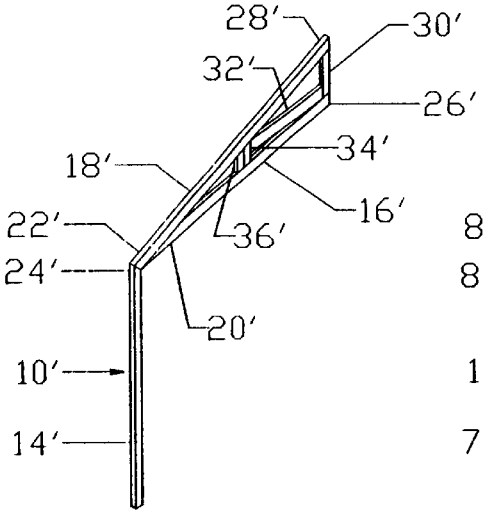
Figure 1D:
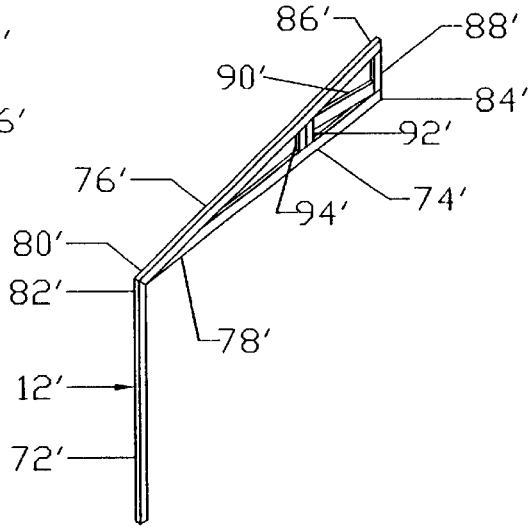

The building system disclosed herein is a result of a gradual recognition on the part of the inventor that the design of almost every home, if not every home, could, in effect, be cut into certain basic parts or "components"; that those basic components could be separately duplicated as many times as necessary; and that then those basic components could be selectively arranged and positioned like three-dimensional building blocks in different ways and assembled together to achieve an infinite variety of home designs.

It should be understood that the building system disclosed herein is not solely limited to "homes" in the sense of a private or single resident family home, but may also apply to apartment buildings, condominiums and small commercial buildings having pitched or inclined roofs.

The inventor then realized that these parts or "components" could be designed to incorporate all the necessary architectural and engineering standards that would be required to meet state and local standards; that the selective arrangement and to positioning of these components could be accomplished in accordance with the wishes of the homeowner to-be or home building contractor; and that the assembly of these components could be accomplished with minimal carpentry skills.

Although the reference above of "minimal carpentry skills" naturally suggests the use of wood in the construction of the disclosed components of the invention, it should be understood that the invention is not limited solely to the use of wood, but may also involve the use of steel or other suitable metals, suitable plastic construction materials, compositions of any other materials, or combinations of any of the aforementioned materials.

The inventor further realized that a home, apartment building, condominium or small commercial building, which have the above-mentioned pitched or inclined roofs, enclose or define space only in a limited number of configurations. In some instances only a few of these configurations may be used, and may also be repeated in the same construction; and in other instances perhaps all of these configurations may be used and may also be repeated in the same construction. These configurations for enclosing space in a particular manner in a home, apartment building, condominium or small commercial building, which have the aforementioned pitched or inclined roofs, become in this invention the "components" described herein, and where the word "home" is used herein it is intended to apply to these different building constructions, as mentioned above.

If all necessary architectural and engineering construction standards to meet and in many cases exceed state and local building construction standards are incorporated in the constructed and completed components described herein, then it is no longer necessary to be concerned about how the framing for a "home" should go together or should be erected because that would already be accomplished in the completed components described herein. The only concern remaining, therefore, would be the selective arrangement of these components to achieve the desired "home," which could be accomplished by anyone, irrespective of their skills or lack of skills, just so long as the end result of the exterior appearance of the "home" is pleasing to the homeowner to-be.

These configurations or "components" would also serve to educate people on how to build the exterior of a "home," and they would no longer have to think of a house or home having walls, but rather of space confined and configured in a particular manner.

These configurations or "components" could be reduced to small modeling blocks for the homeowner to-be to selectively arrange and re-arrange on a flat surface until a result is obtained that would be pleasing to the homeowner to-be, without having to consult a draftsman or architect to design a home. The modeling blocks would serve as a tool for looking at certain space configurations instead of looking at individual studs, framing, and the like. The modeling blocks can also serve as toys to educate children as to how to build a home, at least as far as the exterior appearance is concerned. The well-known Lincoln Logs® have entertained children since about 1918 by the children learning to simply assemble individual interlocking parts into walls, which are formed at right angles, and then to add to the top of the walls a roof, as for the construction of a log cabin, for example. Here again, however, the children are learning about the assembly of individual construction members, and not about the concept of confining space into the different but limited configurations one sees present in homes, apartment buildings, condominiums, and small commercial buildings, which have pitched or inclined roofs.

The same results can be achieved if each configuration or "component" were to be generated or entered in a "file" of a computer and shown in four different orientations, and then by use of a mouse, each particular orientation of a component may be selected to take a particular position in the drawing of a home so that the home can be seen from different perspectives.

In the absence of or lack of a computer, a template may be devised having formed therein the different orientations of each configuration or "component."

The manner of construction of these parts or "components," which incorporate the architectural and engineering standards, commences, therefore, by reference to the drawings, and initially to FIGS. 1(*a*) and 1(*b*). 10 in FIG. 1(*a*) is directed to a secondary rib that constitutes a fundamental element of most of the three dimensional, self-aligning, self-engineering components that will be described in this invention; and 12 in FIG. 1(*b*) is directed to a primary rib that constitutes an essential element of two of the components that will be described in this invention.

In FIG. 1(*a*) the secondary rib 10 comprises a secondary vertical member 14, a secondary inclined lower chord member 16 and a secondary inclined upper chord member 18, which overlies the secondary inclined lower chord member in paired relationship.

The secondary inclined upper chord member 18 is shown as providing a dual pitch, i.e., the initial length of the secondary inclined upper chord member extends at one angle with respect to and from the secondary vertical member 14, and then about intermediate of its length it breaks to extend at a different angle with respect to the secondary vertical member 14. It should be recognized, however, that the secondary inclined upper chord member 18 may also be a single pitch in which it extends from the secondary vertical member 14 at the same angle throughout the length of the second inclined upper chord member 18, as shown in the embodiment of FIG. 1(*c*). It should, therefore, be understood that although the drawings show constructions of dual pitch inclined roof truss sections, the inclined roof truss sections may also be single pitch. The invention is not limited to a particular pitch, single, dual, or any other kind of pitch.

The secondary vertical member 14 is designed to be a load-bearing member in the outside perimeter wall of a home, and it will correspond to a wall stud as used in homes of the prior art, and it has a predetermined length that will generally correspond to the intended perimeter outside height of one story of a home. By use of the term "predetermined," this means that a specific length has been decided upon beforehand in the architectural and engineering sense, and is intended to remain a constant for all components in which it is used in a series of homes. In other words, it is intended to describe a standard, whatever that standard may have been decided upon beforehand, and thus it is "predetermined." It should be appreciated, however, that other standards may be chosen, but the lengths in those cases will still be "predetermined."

The secondary inclined lower chord member 16 and the secondary inclined upper chord member 18 each also has a predetermined length; and they are connected at their lower ends, 20 (for the secondary inclined lower chord member), 22 (for the secondary inclined upper chord member), to the upper end 24 of the secondary vertical member 14, and are connected at their upper ends, 26 (for the secondary inclined lower chord member), 28 (for the secondary inclined upper chord member), to form part of a series of multiple polygon configured reinforcements in an inclined roof truss section.

The simplest definition of a "polygon" is that it is a closed plane figure bounded by three or more line segments. A triangle, for example, is the simplest polygon. The secondary inclined lower chord member 16 and the secondary inclined upper chord member 18 (of the secondary rib 10), as connected by their respective upper ends 26 and 28 to the end base connecting segment 30, encompass a main triangle (disregarding the dual pitch aspect of the secondary inclined upper chord member 18), which in turn is divided into three smaller triangles to form a truss, all of which form a reinforced truss section. A diagonal connecting segment 32 extends from one end portion of the end base connecting segment 30 where it also intersects with and connects to one side of the secondary inclined lower chord member 16; and the diagonal connecting segment 32 at its other end intersects with and connects to one side of the secondary inclined upper chord member 18 and one end portion of a second end base connecting segment 34; the other end portion of the second end base connecting segment 34 intersects with and is connected to the secondary inclined lower chord member 16 about intermediate of the length of the latter. A third end base connecting segment 36 intersects with and is connected at its one end to the secondary inclined lower chord member 16; it intersects with and is connected at its other end to the secondary inclined upper chord member 18; and it is in abutment along its length with the length of the second end base connecting segment 34. The aforementioned main triangle, therefore, is formed by the end base connecting segment 30, and the secondary inclined lower and upper chord members 16, 18 at the location where their respective lower ends 20, 22 intersect. A smaller triangle is formed by the end base connecting segment 30, the diagonal connecting segment 32 and a portion of the length of the secondary inclined upper chord member 18. A second smaller triangle is formed by the second end base connecting segment 34, the diagonal connecting segment 32 and a portion of the length of the secondary inclined lower chord member 16. The third triangle is formed by the third end base connecting segment 36, a portion of the length of the secondary inclined lower chord member 16 and a portion of the length of the secondary inclined upper chord member 18. The resulting main triangle and the three smaller triangles, as defined by the elements forming the triangles, all constitute part of the aforementioned series of multiple polygon configurated reinforcements and serve to transmit any load placed thereon to the secondary vertical member 14 of the secondary rib 10.

Expansion Section Component

Figure 2A:
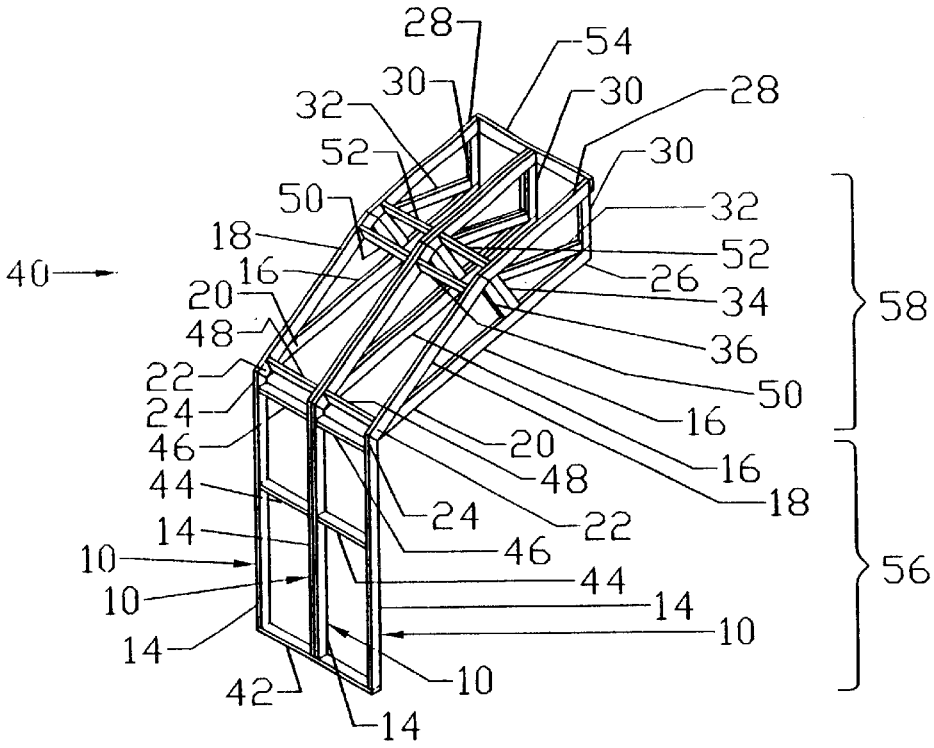
FIG. 2(*a*) is an isometric view of an expansion section component and illustrating an inclined roof truss section having a dual pitch, and employing the dual pitch secondary rib of the embodiment shown in FIG. 1(*a*)
Figure 2B:
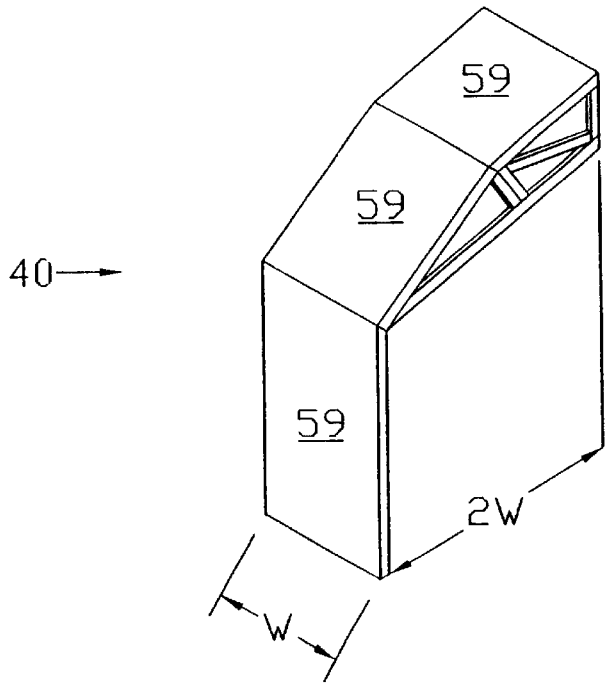

In reference to FIG. 2(*a*) of the drawings, 40 is directed to one of the components of the invention, identified herein as an "expansion section component." This latter component may be built with multiples of the secondary rib 10, which are connected together. In the embodiment illustrated in FIG. 2(*a*), the center most secondary rib 10 comprises two such secondary ribs abutting together in face-to-face relationship. One of the purposes of this arrangement is to facilitate assembly of the expansion section component. Other purposes are to provide a component having greater integral strength and stability. The outer two secondary ribs 10 are equally spaced in parallel relationship from the center two secondary ribs 10, as for example, about sixteen (16) inches or about twenty four (24) inches on center of each secondary vertical member 14, in the manner as conventional wall studs are typically positioned in a home of the prior art.

A sole plate 42 is connected across and to the bottom ends of the secondary vertical members 14 of the secondary rib 10. Horizontal connecting members 44 are connected about midway along the length of secondary vertical members 14 from the sole plate 42. In reference again to each of the two secondary ribs 10 abutting each other in face-to-face relationship, the horizontal connecting members are more easily secured by nailing or screwing at right angles through the secondary ribs and into the ends of the horizontal connecting members without having to "toe-nail" the horizontal connecting members to the secondary ribs and thereby run the risk of the horizontal connecting member being moved out of horizontal alignment in the process and not being at right angles with respect to the secondary ribs. Horizontal connecting members 46 are connected between the upper ends 24 of the secondary vertical members 14. Horizontal connecting members 48 are connected between the lower ends (20, 22, see FIG. 1(*a*)) of the secondary inclined lower and upper chord members. Horizontal connecting members 50 and 52 are connected intermediately of the lengths of the secondary inclined upper chord members 18; and horizontal connecting members 54 are connected across the upper ends 28 of the secondary inclined upper chord members 18.

In further regard to the horizontal connecting members just described, as well as all of the horizontal connecting members that will be described later herein, all horizontal connecting members will be of the same uniform length, facilitating economy of construction and inventory.

The expansion section component 40, the construction of which is described above, is intended to be of uniform height with other expansion section components, and may be selectively arranged, positioned and secured on a previously prepared flat supporting surface in side-by-side relationship with other expansion section components, or with other components, which are to be described hereafter, to form a home.

In the manner of construction of the expansion section component, and as aforementioned, the secondary vertical members 14, the sole plate 42, and the horizontal connecting member 44, 46, collectively, form and constitute a load-bearing vertical wall section 56. The secondary inclined lower chord members 16, secondary inclined upper chord members 18, the horizontal connecting members 48, 50, 52, and the other structural members forming the main triangle and the three smaller triangles, collectively, form and constitute part of the aforementioned series of multiple polygon configurated reinforcements of the inclined roof truss section 58.

Figure 7:
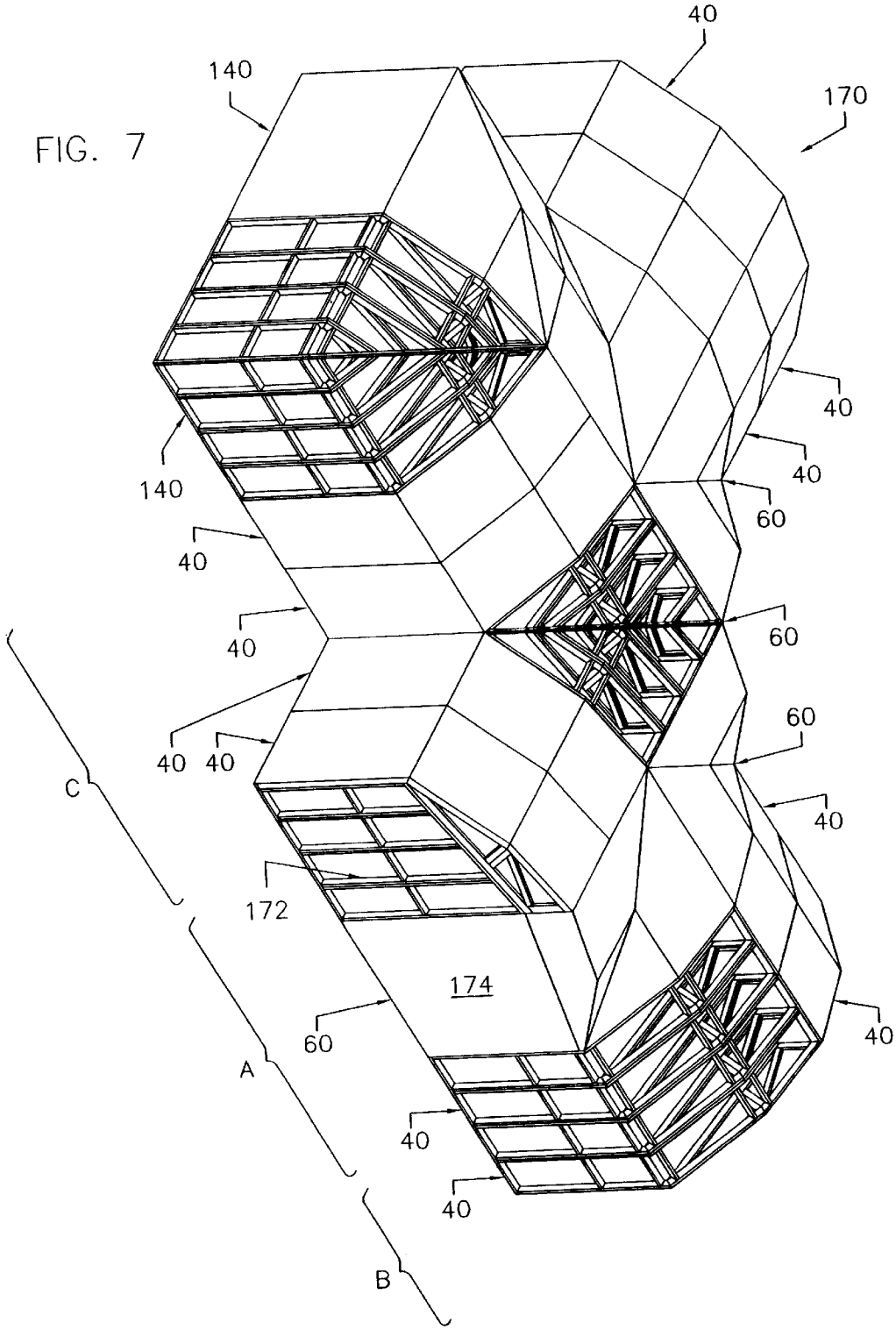
FIG. 7 is an isometric view of one form of home that may be constructed by use of the components described herein and wherein the inclined roof truss sections are dual pitch.

Expansion section components 40 may not only be positioned in side-by-side relationship, but also may be selectively arranged,. positioned and secured, each opposite the other, in reverse relationship to form a gable for a home, for example, and as illustrated in FIG. 7, or positioned with each secured in side-by-side relationship to other components that will be described herein, and as also illustrated in FIG. 7.

In reference to FIG. 2(*b*), the framework of the expansion section component 40 of FIG. 2(*a*) is shown in this drawing figure as being mostly covered by panels 59. This drawing also serves to show that the width of the expansion section component may be W, and the length thereof may be 2W.

Inside Corner Component

Figure 3:
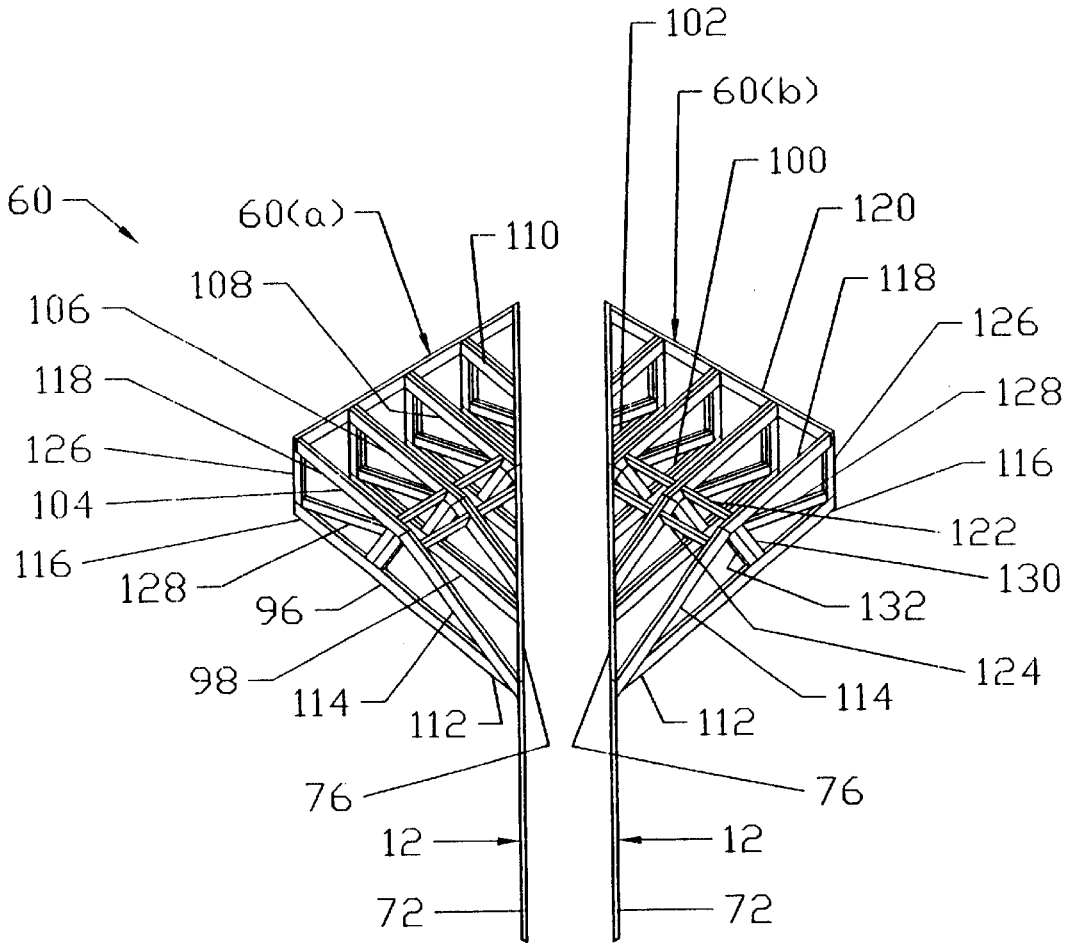
FIG. 3 is an isometric view illustrating the left inside corner component and the right inside component of the inside corner component as separately constructed and wherein the secondary and primary inclined upper chord members have a dual pitch.
Figure 4A:
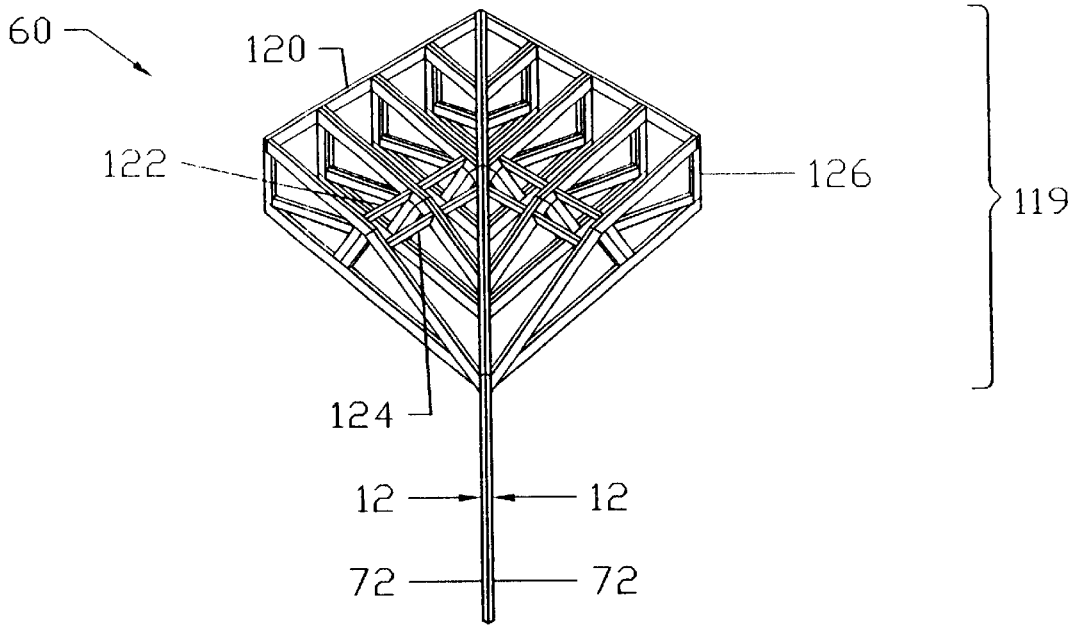
FIG. 4(*a*) is an isometric view illustrating the left inside corner component and the right inside corner component of FIG. 3 assembled and secured together to form the completed inside corner component.
Figure 4B:
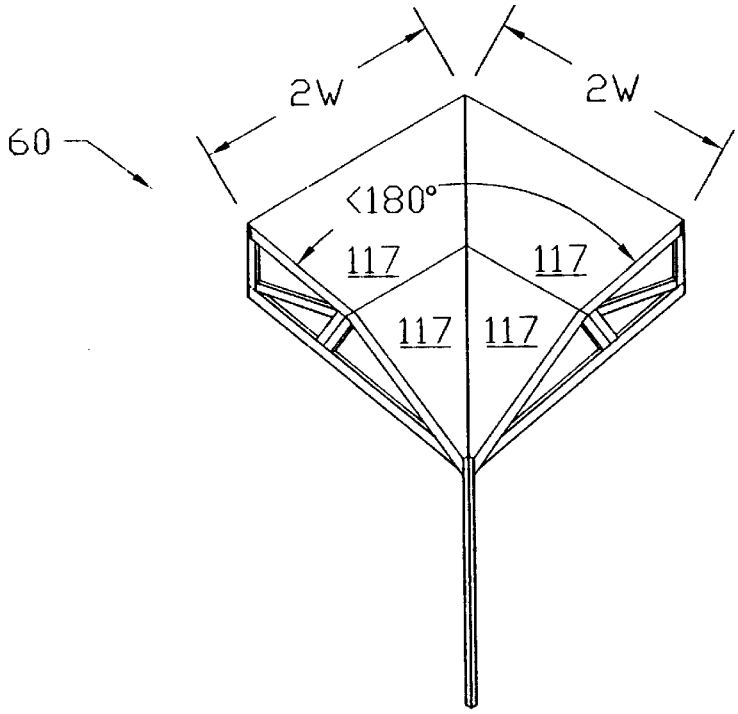

In reference to FIG. 3 and FIG. 4, FIG. 3 illustrates a second of the components of the invention, and is identified herein as "inside corner component" 60, which is divided and separated as the left inside corner component 60(*a*) and the right inside corner component 60(*b*). FIG. 4 illustrates the completed assembly of the left inside corner component 60(*a*) and the left inside corner component 60(*b*) to from the completed inside corner component 60.

In reference to FIG. 1(*b*), the primary rib 12, as previously mentioned, constitutes a fundamental element of two of the three dimensional, self-aligning, self-engineering components to be described herein, including the aforementioned inside corner component 60.

Primary rib 12 comprises a primary vertical member 72, a primary inclined lower chord member 74, and a primary inclined upper chord member 76, which overlies the primary inclined lower chord member 74 in paired relationship. The primary vertical member 72 and the primary inclined upper chord member 76 for the left inside corner component 60(*a*) and the right inside corner component 60(*b*) are each provided with a 45 degree bevel or miter on their narrow edges. In this manner when 60(*a*) and 60(*b*) are united to form the completed inside corner component 60, the resulting two side-by-side primary vertical members 72 and the two side-by-side primary inclined upper chord members 76 will present a right angle corner having flat faces to which appropriate panels may be secured. More significantly, however, the beveled edges or miters enable the use of standard panels having a width of W or 2W, W generally being 4 feet, and 2W being 8 feet. If the two vertical members 72, for instance, from the left inside corner component 60(*a*) and from the right inside corner component 60(*b*) were not beveled or mitered and were to be joined together face-to-face when the two halves of the inside corner component were assembled together, the width of a panel to be attached on either side of the inside corner component would have to be W or 2W plus the width of the vertical member 72. The W primary inclined upper chord member 76, similar to the secondary inclined upper chord member 18 of FIG. 1(*a*), provides a dual pitch, i.e., the initial length of the primary inclined upper chord member extends at one angle with respect to and from the primary vertical member 72 and overlies the primary inclined lower chord member 74, as better seen in FIG. 1(*b*), and then about intermediate of its length it breaks to extend at a different angle with respect to the primary vertical member 72. It should be recognized, however, that the primary inclined upper chord member 76 may also be a single pitch in which it extends from the primary vertical member 72 at the same angle throughout the length of the primary inclined upper chord member 76, as shown in the embodiment of FIG. 1(*d*). Again, as noted previously, it should be understood that although most of the drawings herein show constructions of dual pitch inclined roof truss sections, the inclined roof truss sections may also be single pitch, or any other pitch. The primary vertical member 72 is designed to be a load-bearing member in the outside perimeter wall of a home, and it also will correspond to a wall stud as used in homes of the prior art; and it has a predetermined length that will generally correspond to the intended perimeter outside height of one story of a home. The term "predetermined," as used here has been previously described herein.

The primary inclined lower chord member 74 and the primary inclined upper chord member 76 each also has a predetermined length; and they are connected at their lower ends, 78 (for the primary inclined lower chord member), 80 (for the primary inclined upper chord member), to the upper end 82 of the primary vertical member 72, and are connected at their upper ends, 84 (for the primary inclined lower chord member), 86 (for the primary inclined upper chord member), to form part of the series of multiple polygon configurated reinforcements in an inclined roof truss section, in the same manner as heretofore described with respect to the secondary rib 10.

The primary inclined lower chord member 74 and the primary inclined upper chord member 76 (of the primary rib 12), as connected by their respective upper ends 84 and 86 to the end base connecting segment 88 encompass a main triangle (again, disregarding the dual pitch aspect of the secondary inclined upper chord member 18), which in turn is divided into three smaller triangles to form a truss, all of which form a series of multiple polygon configurated reinforcements in an inclined roof truss section. A diagonal connecting segment 90 extends from one end portion of the end base connecting segment 88, where it also intersects with and connects to one side of the primary inclined lower chord member 74. The diagonal connecting segment 90 at its other end intersects with and connects to one side of the primary inclined upper chord member 76 and one end portion of a second end base connecting segment 92.

The other end portion of the second end base connecting segment 92 intersects with and is connected to the primary inclined lower chord member 74 about intermediate of the length of the latter. A third end base connecting segment 94 intersects with and is connected at its one end to the primary lower chord member 74; intersects with and is connected at its other end to the primary inclined upper chord member 76; and is in abutment along its length with the length of the second end base connecting segment 92. The aforementioned main triangle, therefore, is formed by the end base connecting segment 88, and the primary inclined lower and upper chord members 74, 76 at the location where their respective lower ends 78, 80 intersect. A smaller triangle is formed by the end base connecting segment 88, the diagonal connecting segment 90 and a portion of the length of the primary inclined upper chord member 76. A second smaller triangle is formed by the second end base connecting segment 92, the diagonal connecting segment 90 and a portion of the length of the primary inclined lower chord member 74. The third smaller triangle is formed by the third end base connecting segment 94, a portion of the length of the primary inclined lower chord member 74 and a portion of the length of the primary inclined upper chord member 76. The resulting main triangle and the three smaller triangles, as defined by the elements forming the triangles, all constitute part of the aforementioned series of multiple polygon configurated reinforcements and serve to transmit any load placed thereon to the primary vertical member 72 of the primary rib 12.

It should be noted that the primary vertical member 72 of the primary rib 12 has the same predetermined length as the secondary vertical member 14 of the secondary rib 10. The predetermined lengths of the primary inclined lower chord member 74 and of the primary inclined upper chord member 76 are longer than the predetermined lengths of the corresponding elements of the secondary rib 10.

In reference again to FIG. 3, the left inside corner component 60(*a*) includes a primary left rib 12, and the right inside corner component 60(*b*) includes a primary right rib 12, and each primary left and each primary right ribs 12 have a plurality of secondary inclined lower chord members 96, 98, 100, and 102, having predetermined lengths, and a plurality of secondary inclined upper chord members 104, 106, 108, and 110 having predetermined lengths. It should be noted, as was the case in the construction of the expansion section component, the secondary inclined lower and upper chord members, which are located inwardly from the outermost ones are also doubled in abutting together face-to-face relationship to facilitate construction, and to provide greater integral strength and stability. Each secondary inclined upper chord member overlies a respective secondary inclined lower chord member in paired relationship. The secondary inclined lower chord members 96, 98, 100, 102 and the secondary inclined upper chord members 104, 106, 108, 110, are connected at their respective lower ends 112 (collective representation of the four lower ends of the secondary inclined lower chord members), 114 (collective representation of the four lower ends of the secondary inclined upper chord members), respectively, to and spaced at intervals along and inclined outwardly from the primary inclined lower chord member 74 (see FIG. 1(*b*)); and are connected at their upper ends 116 (collective representation of the four upper ends of the secondary inclined lower chord members), 118 (collective representation of the four upper ends of the secondary inclined upper chord members) to form part of the series of multiple polygon configurated reinforcements in the inclined roof truss section 119 (see FIG. 4(*a*)).

The meaning of "polygon configurated reinforcement" has previously been discussed and is also applicable here as well as wherever else it is mentioned in this specification.

The four upper ends 118 (FIG. 3) of the secondary inclined upper chord members 104, 106, 108 and 110 for each of the left inside corner component 60(*a*) and the right inside corner component 60(*b*) are connected to a horizontal connecting member 120. A second and third horizontal connecting members 122, 124 are connected spaced from each other intermediately of the lengths of three of the secondary inclined upper chord members 104, 106 and 108. As noted with respect to the expansion section component, the doubled abutting together in face-to-face m relationship of the secondary inclined lower and upper chords enable these horizontal connecting members to be secured at right angles with respect to these chord members. Each of the secondary inclined lower chord members 96, 98, 100, 102 and the secondary inclined upper chord members 104, 106, 108, 110 are connected at their respective upper ends 116, 118 to an end base connecting segment 126 (collective representation for the four end base segments shown in FIGS. 3 and 4(*a*)). A diagonal connecting segment 128 (collective representation of the four diagonal connecting segments shown for the primary left and the primary right ribs 12 in FIGS. 3 and 4(*a*)) extends from one end portion of the end base connecting segment 126 where it also intersects with and connects to one side of the secondary inclined lower chord member (96, 98, 100, 102); and the diagonal connecting segment 128 at its other end intersects with and connects to one side of the secondary inclined upper chord member (104, 106, 108, 110) and one end portion of a second end base connecting segment 130 (collective representation for the three second end base connecting segments 130); the other end portion of the second end base connecting segment 130 intersects with and is connected to the secondary inclined lower chord member (96, 98, 100, 102) about intermediate of the length of the latter. A third end base connecting segment 132 (collective representation for the three third end base connecting segments 132) intersects with and is connected at its one end to the secondary inclined lower chord member (96, 98, 100, 102); it intersects with and is connected at its other end to the secondary inclined upper chord member (104, 106, 108); and it is in abutment along its length with the length of the second end base connecting segment 130.

Each of the secondary inclined lower chord members (96, 98, 100, 102) and the secondary inclined upper chord members (104, 106, 108, 110), as connected by their respective upper ends (116, 118) to the end base connecting segment 126 encompass a main triangle (still again, disregarding the dual pitch aspect of the secondary inclined upper chord member 18), which in turn is divided into three smaller triangles (except for secondary inclined lower chord members 102 and secondary inclined upper chord members 110) to form a truss, all of which form part of the series of multiple polygon configurated reinforcements in the inclined roof truss section 119 (FIG. 4(*a*)).

The left inside corner component 60(*a*) and the right inside corner component 60(*b*) are each separately constructed, for ease of construction, and may also be sold in this manner for subsequent assembly on a building site of both into the assembled inside corner component 60 shown in FIG. 4(*a*). When assembled, the primary left and primary right ribs 12 are suitably fastened together to result in the completed assembled inside corner component 60.

One of the purposes of the inside corner component, as may be noted in FIG. 7, is to change direction of the different components illustrated in a home being constructed. For instance, the individual components leading to the left side of the inside corner component are at right angles with respect to the individual components leading away from the right side of the inside corner component. It will, therefore, be recognized that the inside corner component enables and facilitates this change of direction.

In reference to FIG. 4(*b*), the framework of the inside corner component 60 of FIG. 4(*a*) is shown in this drawing as being mostly covered by panels 117. This drawing also serves to show that the length along each side of the inside corner component may be 2W.

Outside Corner Component

Figure 5:
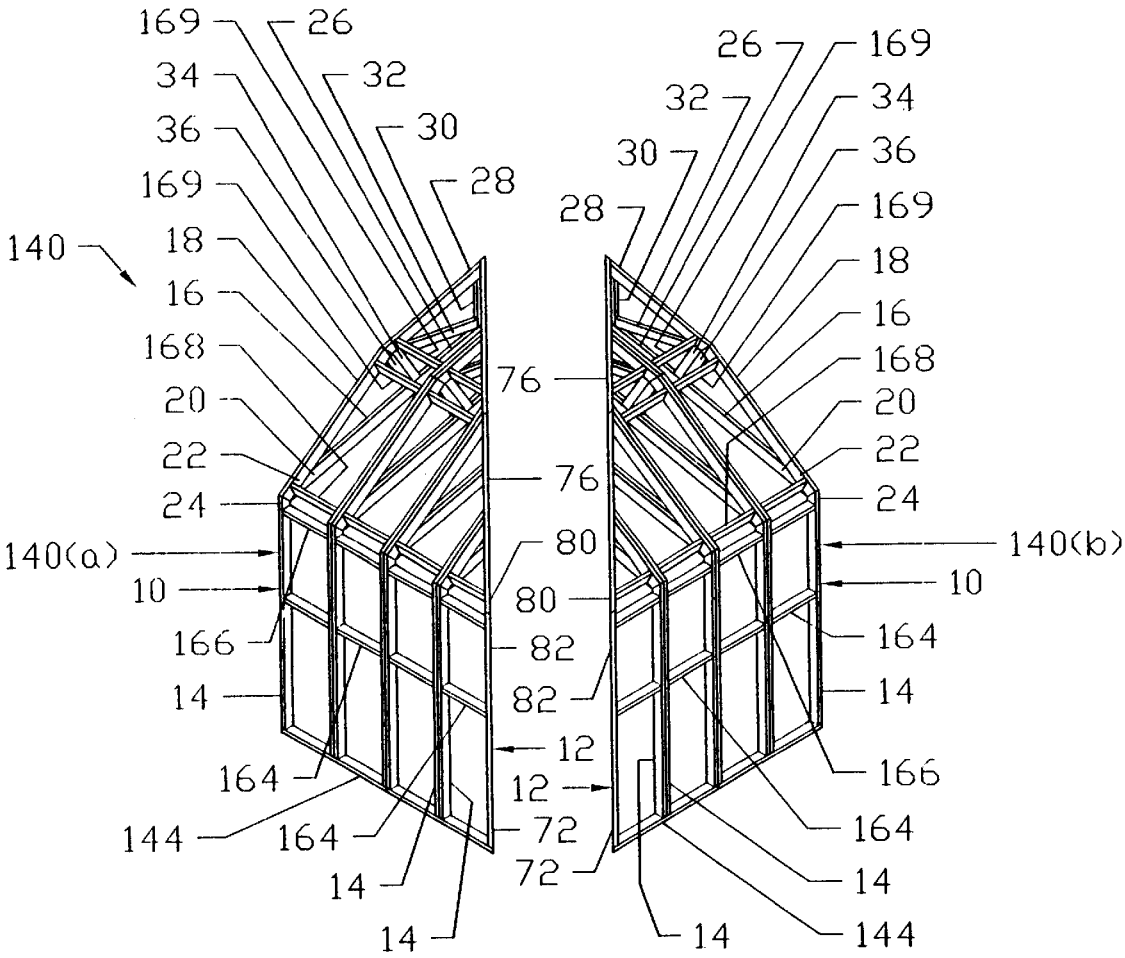
FIG. 5 is an isometric view of the left outside corner component and the right outside corner component as separately constructed and wherein the secondary and primary inclined upper chord members have a dual pitch.
Figure 6A:
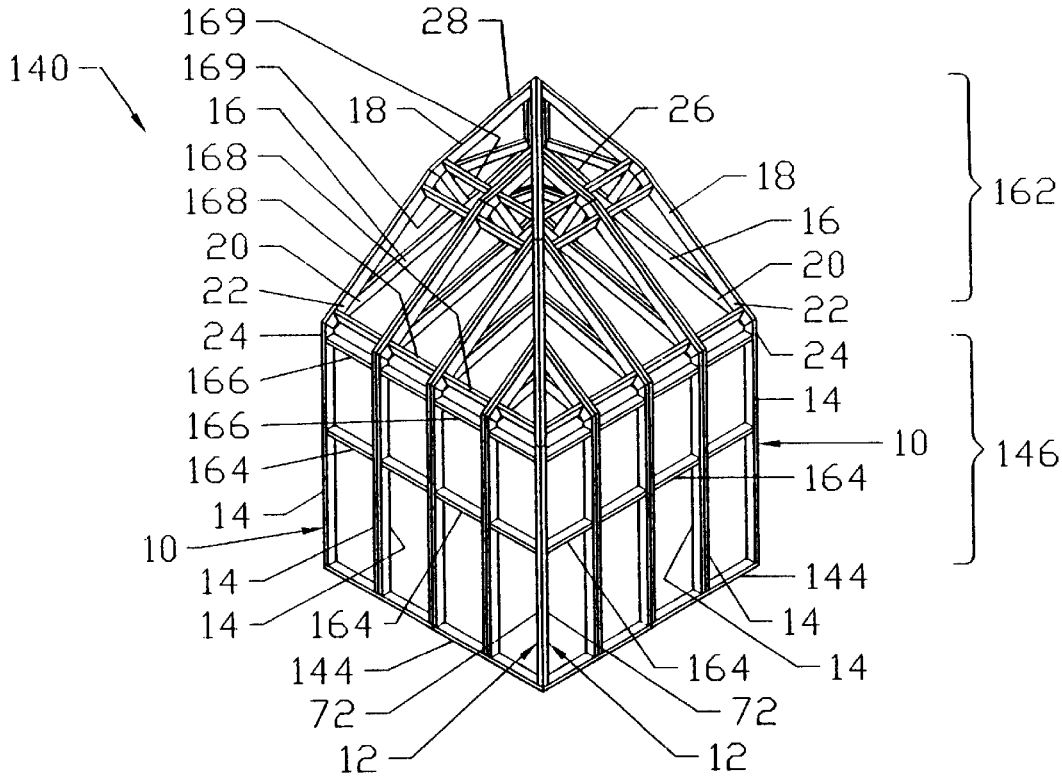
FIG. 6(*a*) is an isometric view of the left outside corner component and the right outside corner component of FIG. 5 assembled and secured together to form the completed outside corner component.
Figure 6B:
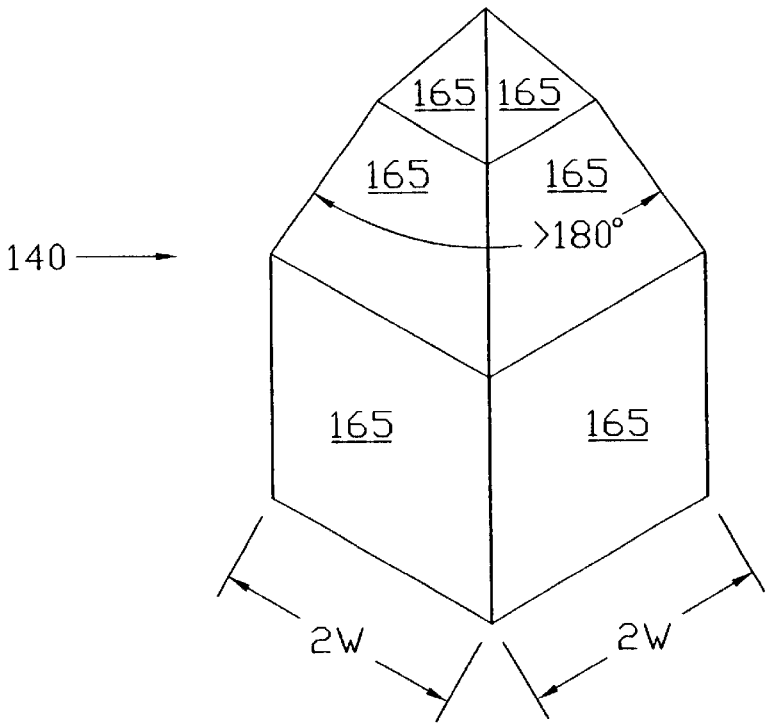

In reference to FIG. 5 and FIG. 6(*a*), FIG. 5 illustrates another of the components of the invention, and is identified herein as "outside corner component" 140, which is divided and separated as the left outside corner component 140(*a*) and the right outside component 140(*b*). This latter component may also be built with multiples of the secondary rib 10, which are connected together. In the embodiment illustrated in FIG. 5, for example, the three central secondary ribs 10 each comprise two such secondary ribs 10 abutting together in face-to-face relationship. As indicated previously, the purpose of this arrangement is to facilitate assembly of the outside corner component. Other purposes are to provide a component having greater integral strength and stability. The secondary ribs 10 are equally spaced about sixteen (16) inches on center or about twenty-four (24) inches on center of each secondary vertical member 14, in the manner as conventional wall studs are typically positioned in a home of the prior art.

FIG. 6(*a*) illustrates the completed assembly of the left outside component 140(*a*) and the right outside corner component 140(*b*) to form the outside corner component 140. Again, as noted earlier, although the inclined roof truss sections are shown as being dual pitch, they also may be single pitch or any other combinations of pitches.

In reference to FIG. 5, the primary rib 12, as previously described with respect to FIG. 1(*b*), constitutes a fundamental element of two of the three-dimensional, self-aligning, self-engineering components to be described herein, including the inside corner component as well as the outside corner component.

The various elements constituting the primary rib 12, as shown in FIG. 1(*b*), have been previously described with respect to the inside corner component 60 and apply equally as well to the outside corner component including the formation of a 45 degree bevel or miter on the narrow sides of the primary vertical members 72 and the primary inclined upper chord members 76 so as to provide a right angle corner having flat faces to which panels may be secured. More significantly, and as indicated previously with respect to the description of the inside corner component 60, the beveled edges or miters formed on the vertical member 72, for instance, of the left outside corner component 140(*a*) and of the right outside corner component 140(*b*), when the two vertical members 72 are united, enable the use of standard panels having a width of W or 2W on each side of the outside corner component without also having to compensate for the width of each vertical member 72, if there had been no formation of a bevel or miter thereon. The primary left and primary right ribs 12 each includes at spaced parallel intervals therefrom a plurality of secondary vertical members 14, which constitute along with the primary vertical member 72 and the sole plate 144, which is connected across and to the bottom ends of the secondary vertical members 14 and the bottom end of the primary vertical member 72, a load-bearing vertical wall section 146 (FIG. 6(*a*)). Each of the plurality of secondary vertical members 14 and the primary vertical member 72 have the same predetermined lengths.

Each primary left and primary right ribs in FIG. 5 also includes a plurality of secondary inclined lower chord members 16 having predetermined lengths and a plurality of secondary inclined upper chord members 18 having predetermined lengths and each overlying a respective secondary inclined lower chord member 16 in paired relationship, and connected, respectively, at their respective upper ends 26 (collective representation for upper ends for secondary inclined lower chord member), 28 (collective representation for upper end for secondary inclined upper chord member) to and spaced at intervals along and inclined outwardly from the primary inclined lower chord member 74 (see FIG. 1(*b*)) and the primary inclined upper chord member 76 (see FIG. 1(*b*) and FIG. 5); and connected at their lower ends 22 (collective representation for lower ends of secondary inclined lower chord members), 20 (collective representation for lower ends of secondary inclined upper chord members) connected to the upper end 24 of a secondary vertical member 14 to form part of a series of multiple polygon configurated reinforcements in an inclined roof truss section 162 (FIG. 6(*a*)). Horizontal connecting members 164 are installed between the primary vertical member 72 and the first secondary vertical member 14, and between the other secondary vertical members 14 about intermediate of the length of the primary and secondary vertical members 72, 14. Additional horizontal connecting members 166, 168 are installed at the upper ends 82, 24, of primary and secondary vertical members 72, 14 and at the lower ends 80 (see also FIG. 1(*b*)), 20 of primary and secondary inclined upper chord members 76, 18, and horizontal connecting members 169 are installed about intermediate of the lengths of and between the primary and secondary inclined upper chord members 76, 18. These horizontal connecting members serve to unite and space the primary and secondary ribs 12, 10 from each other. As noted with respect to the expansion section component and the inside corner section component, the three inner most secondary ribs 10 of the outside corner section component are each also doubled in abutting face-to-face relationship to another secondary rib 10 to facilitate construction, and to provide greater integral strength and stability.

In reference to FIG. 5, and as previously described with respect to FIG. 1(*a*) (the secondary rib 10) and FIG. 2 (the expansion section component 40), the secondary inclined lower chord member 18 of the secondary rib 10, as connected by their respective upper ends 26 and 28 to the end base connecting segment 30 encompass a main triangle (disregarding, of course, the dual pitch aspect of the secondary inclined upper chord member 18), which in turn is divided into three smaller triangles to form a truss, all of which form a reinforced truss section, as previously mentioned. A diagonal connecting segment 32 extends from one end portion of the end base connecting segment 30 where it also intersects with and connects to one side of the secondary inclined lower chord member 16. The diagonal connecting segment 32 at its other end intersects with and connects to one side of the secondary inclined upper chord member 18 and one end portion of a second end base connecting segment 34. The other end portion of the second end base connecting segment 34 intersects with and is connected to the secondary inclined lower chord member 16 about intermediate of the length of the latter. A third end base connecting segment 36 intersects with and is connected at its one end to the secondary inclined lower chord member 16; it intersects with and is connected at its other end to the secondary inclined upper chord member 18; and it is in abutment along its length with the length of the second end base connecting segment 34. The aforementioned main triangle, therefore, is formed by the end base connecting segment 30, and the secondary inclined lower and upper chord members 16, 18 at the location where their respective lower ends 20, 22 intersect. A smaller triangle is formed by the end base connecting segment 30, the diagonal connecting segment 32 and a portion of the length of the secondary inclined upper chord member 18. A second smaller triangle is formed by the second end base connecting segment 34, the diagonal connecting segment 32 and a portion of the length of the secondary inclined lower chord member 16. The third triangle is formed by the third end base connecting segment 36, a portion of the length of the secondary inclined lower chord member 16 and a portion of the length of the secondary inclined upper chord member 18. The resulting main triangle and the three smaller triangles, as defined by the elements forming the triangles, all constitute part of the aforementioned series of multiple polygon configurated reinforcements and serve to transmit any load placed thereon to the secondary vertical member 14 of the secondary rib 10.

As previously indicated with respect to the left inside corner component 60(*a*) and right inside corner component 60(*b*) of FIG. 3, it is easier to construct the left outside corner component 140(*a*) and the right outside corner component 140(*b*) of FIG. 5 separately, and to sell same separately in this manner for subsequent transfer to a building site for assembly of both into the assembled outside corner component 140, as shown in FIG. 6(*a*). When assembled, as shown in FIG. 6(*a*), the primary left and primary right ribs 12 are suitably fastened together to result in the completed assembled outside corner component 140. In such assembly, the left outside corner component 140(*a*) and the right outside corner component 140(*b*) are each readily movable into position on a previously prepared flat supporting surface to form the assembled outside corner component 140, which is part of the perimeter wall of the home shown in FIG. 7.

In reference to FIG. 6(*b*), the framework of the outside corner component 140 of FIG. 6(*a*) is shown in this drawing as being covered by panels 165. This drawing also serves to show that the length along each side of the outside corner component may be 2W.

Home of FIG. 7

In reference to the home plan shown in FIG. 7, the componentized, three dimensional, self-aligning, self-engineering building system, as described thus far, and as incorporated into the home, which is indicated generally at 170, is constructed of only multiples of the expansion section component 40, of the inside corner component 60 and of the outside corner component 140. The individual home owner to-be or a building contractor may readily go to a local building supply company such as Lowe's or Home Depot, and order so many of each type of component, and then have them transported to the building site where the foundation and flat supporting surface have been previously prepared. The home, as illustrated in FIG. 7, may be readily assembled on the previously prepared flat supporting surface within a working day. Windows and entry door frames, if their locations are known beforehand, are preferably formed at the manufacturing plant, but could be formed at the building site, if necessary, even though it would not be as economical as being formed at the manufacturing plant. The components, as purchased, may have previously been completed outside with whatever exterior wall covering is required, such as wood sheathing, wafer board, plywood, OSB (oriented strand board) or the like, and appropriately insulated interiorly.

Alternatively, sections of components may be selectively arranged, positioned and secured together at the manufacturer's plant, instead of at the building site. In this manner, the manufacturer has been instructed beforehand where window frames and door frames are to be installed, and these window and door frames will be constructed and installed at the manufacturer's plant. These sections of components are thereafter transported to the building site and the sections are installed and connected together in accordance with the specifications provided by the home-owner to-be or by the building contractor.

As will be noted from FIG. 7, each expansion section component 40 is positioned against an oppositely facing expansion component 40, to form a pair of expansion section components, as well as positioned in side-by-side relationship with another pair of expansion section components to form at least four gables. A "gable," generally speaking, is a triangular wall enclosed by the sloping ends of a ridged roof, but more particularly means the whole section, including wall, roof, and the space enclosed. The gables shown in FIG. 7 may also be known as cross gables, because one gable A crosses at right angles with respect to gable B, for example, with the transition between the two gables being accomplished by installation of the inside corner component 60, and likewise between gable A and gable C, the latter, however, terminating in the installation of two side-by-side outside corner components 140, which complete one end of the home, as illustrated.

In reference to gable A in FIG. 7, when the expansion section component 40 is positioned at the outermost end of the gable, as shown by gable A, supporting frame work 172 may form the end wall that is secured beneath the inclined roof truss section (as shown at 58 in FIG. 2(*a*)) of the expansion section component 40 in the manner illustrated, and may be covered with an appropriate panel, such as OSB, as illustrated by the OSB panel 174 shown adjacent the illustrated supporting framework 172.

It should now be apparent that the combinations possible with just the three components (40, 60, 140) described thus far are limitless, and are certainly not limited to the particular arrangements of components for the home shown in FIG. 7. A home could be constructed, for example, solely of pairs of expansion section components 40 only. A simple shed (not shown), for instance, in which the roof slopes only in one direction can be constructed solely of expansion section components positioned in side-by-side relationship on one side with the opposite side filled in by an appropriate vertical wall section, such as framing similar to 172 in FIG. 7, instead of using oppositely facing expansion section components.

Flat Truss Section Component

The size or depth of the constructed home is not limited to the extent that one inclined roof truss section of one component meets with the oppositely facing inclined roof truss section of another component, as shown in FIG. 7. A flat truss section component 180, as shown in FIG. 8, may be used in the manner illustrated in FIG. 9, or in multiples in the manner illustrated in home 176 of FIG. 10, to extend the size or depth of a home. As illustrated, the length of the flat truss section component 180 may be varied, or may be extended by joining these components in end-to-end relationship, or, as also illustrated, the width may be varied by positioning the components in side-by-side relationship, as illustrated in the home 176 shown in FIG. 10.

Each flat truss section component includes pairs of horizontally extending lower chord members 182 and pairs of horizontally extending upper chord members 184 each overlying one of the horizontally extending lower chord members 182 in spaced parallel relationship; and they are connected together in side-by-side relationship to define a rectangular cross-section having a predetermined width and a predetermined length longer than the aforementioned predetermined width.

Each horizontally extending lower chord member 182 and the overlying horizontally extending upper chord member 184 has connected therebetween a series of reinforcing members 186, 188 formed in polygon configurations. Each reinforcing member 186 is a vertical connecting member, and each reinforcing member 188 is a diagonal connecting member.

Each horizontally extending lower chord member 182 and its overlying horizontally extending upper chord member 184 of the flat truss section component may be connected to two other sets or pairs of horizontally extending lower and upper chord members of another flat truss section component by multiple horizontally extending lower connecting members 190 and multiple horizontally extending upper connecting members 192. The horizontally extending lower and upper connecting members 190, 192 at each end of the flat truss section component 180 constitute, therefore, a pair of end members each parallel to the other. The outermost horizontally extending lower and upper chord members 182, 184 for each side of a flat truss section component constitute, therefore, a pair of side members each parallel to the other, and are adapted to engage and to be connected to another component, which may be to another flat truss section component, to an inside corner component, or to an outside corner component, or to a combination of components (see FIG. 10).

Each flat truss section component 180, as described thus far, is adapted to engage at each pair of end members (190, 192) an inclined roof truss section of one of the components, as for example, the inclined roof truss section 58 (see FIG. 2(*a*)) of the expansion section component 40, as illustrated in FIG. 9.

Figure 10:
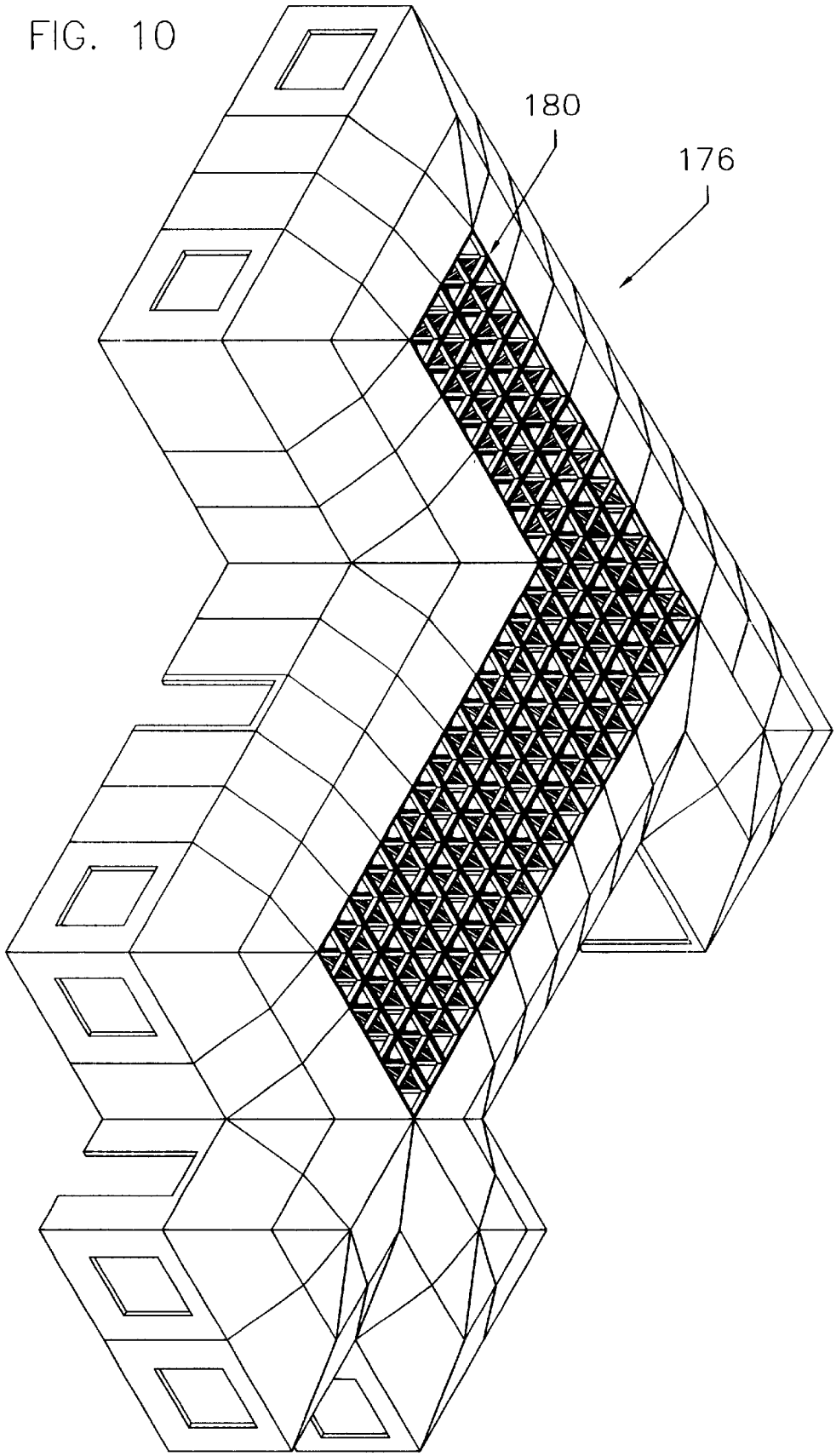
FIG. 10 is an isometric view of another form of home that may be constructed to enlarge the depth or size of a home with the use of the illustrated flat truss section components and wherein the inclined roof truss sections are dual pitch.
Figure 11:
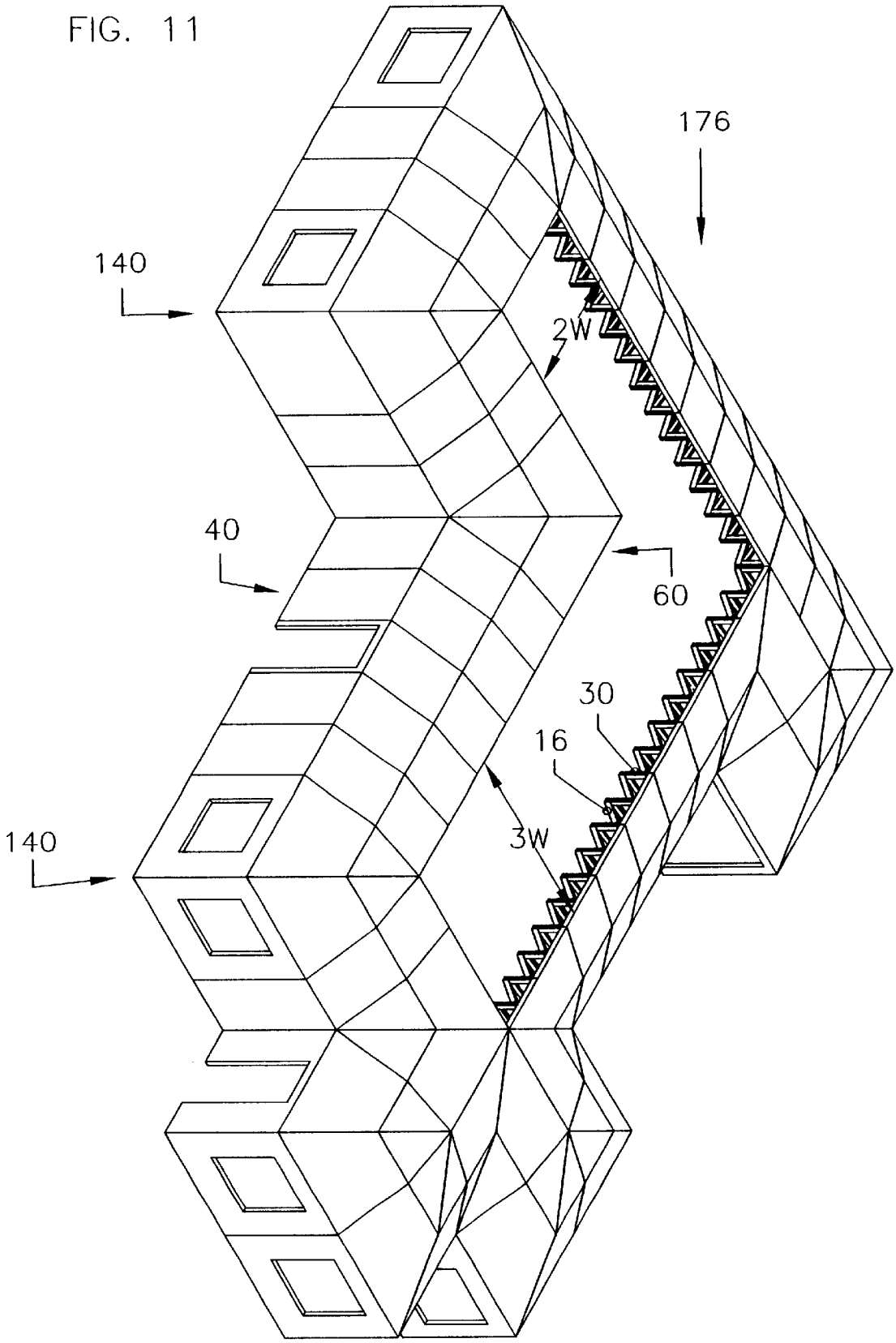
FIG. 11 is an isometric view of the form of home shown in FIG. 10 and illustrates the upper ends of the inclined roof truss section components prior to installation of the flat truss section components shown in FIG. 10 to which the flat truss section components will be attached.

In reference to FIG. 11, this drawing shows the construction of the home 176 that has an open area within the center of the home structure that may be bridged, appropriately, with the flat truss section components 180 in the manner illustrated in FIG. 10. In FIG. 11, it will be noted that the lower and upper ends of the inclined roof truss sections of the different components are shown prior to being connected to the flat truss section components in the manner already accomplished in FIG. 10, such as end base connecting segment 30 and secondary inclined lower chord member 16, as shown in FIG. 11. The central open area leading toward the right in FIG. 11 has a greater span (3W) than the central open area (2W) leading toward the left. The flat truss section components 180 spanning the first mentioned open area are a third longer than the flat truss section components 180 spanning the second mentioned open area. The spanning distance of the flat truss section components, however, are not limited, of course, to that shown in the home illustrated in FIGS. 10 and 11. Such spanning distances may be greatly varied, depending upon what is wanted by the homeowner to-be of a home to be constructed in this manner.

Roof Truss Joiner Cap, Roof Truss Hip Cap and Roof Truss Expansion Cap

Figure 12:
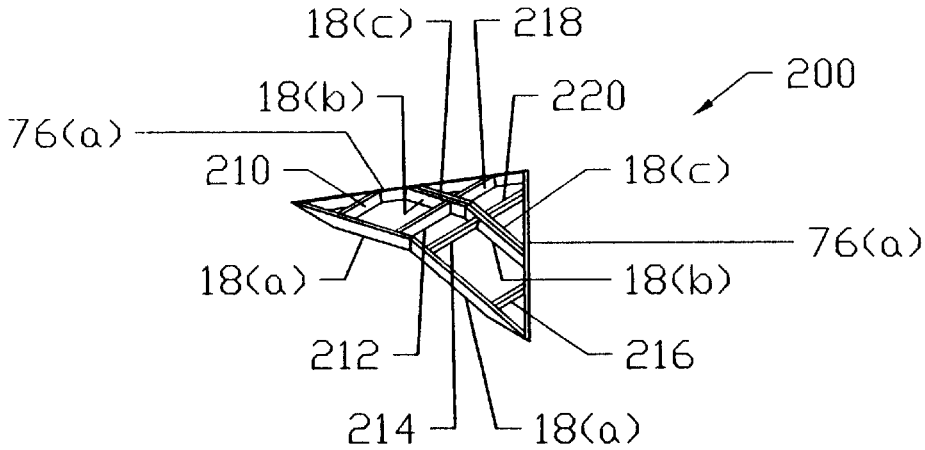
FIG. 12 is an isometric view of a roof truss joiner cap to be installed over a flat truss section component.
Figure 13:
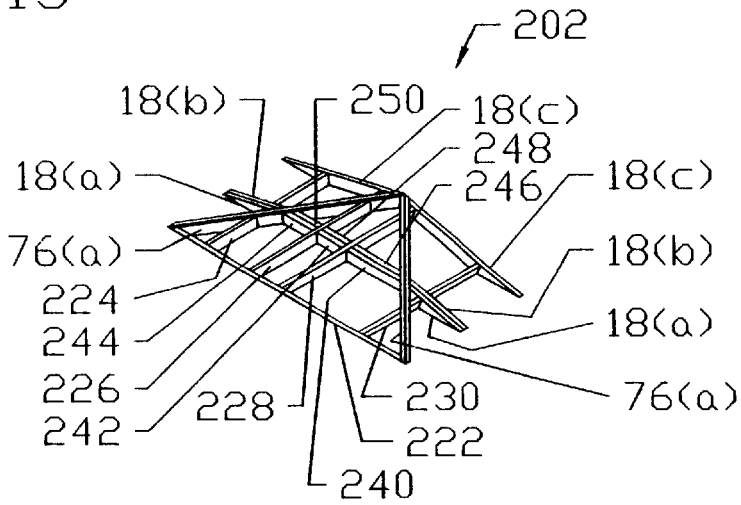
FIG. 13 is an isometric view of a roof truss hip cap to be installed over a flat truss section component.
Figure 14:
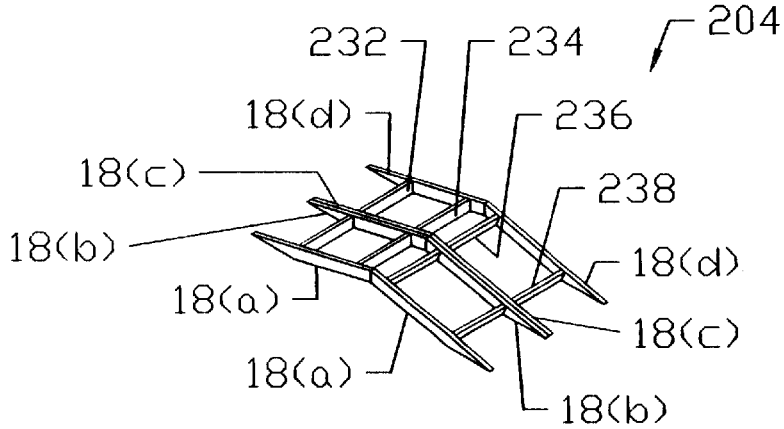
FIG. 14 is an isometric view of a roof truss expansion cap to be installed over a flat truss section component.

Once the flat roof truss sections have been installed, the roof pitch over these flat areas are completed by roof truss caps, such as the roof truss joiner cap in FIG. 12 shown at 200, the roof truss hip cap in FIG. 13 shown at 202, and the roof truss expansion cap in FIG. 14 shown at 204, all in the manner illustrated in the drawings.

In reference to FIG. 12, the roof truss joiner cap 200 comprises, in effect, extensions of the secondary inclined upper chord member 18 of FIG. 1(*a*) and designated in FIG. 12 as 18(*a*), 18(*b*), and 18(*c*); and extensions of the primary inclined upper chord member 76 of FIG. 1(*b*) and designated in FIG. 12 as 76(*a*). Each extension 76(*a*) is connected at its one end to one end of one of the extensions 18(*a*) and at its other end it is connected to one end of the other extension 76(*a*). The extensions 18(*a*) of the roof truss joiner cap 200 each provide a flat face that is inclined from the vertical plane less than 90 degrees to conform to the pitch of the roof and of the roof truss expansion caps and of the roof truss hip caps to be described and for a purpose that will also be described. The extensions 18(*a*), 18(*b*), 18(*c*), and 76(*a*) are further connected together by horizontal connecting members 210, 212, 214, 216, 218 and 220.

In reference to FIG. 13, the roof truss hip cap 202 also comprises, in effect, extensions of the secondary inclined upper chord member 18 of FIG. 1(*a*) and designated in FIG. 13 as 18(*a*), 18(*b*) and 18(*c*); and extensions of the primary inclined upper chord member 76 of FIG. 1(*b*) and designated in FIG. 13 as 76(*a*). Each extension 76(*a*) is connected at its one end to one end of the other extension 76(*a*), both ends also intersecting extensions 18(*c*), and at its other end it is connected to one end of a flat connecting member 222. The extensions are further connected together by horizontal connecting members 224, 226, 228 and 230. Because of the presence of the two extensions 76(*a*), extensions 18(*a*) and 18(*b*) terminate at their intersection with extensions 76(*a*). Connecting block members 240, 242, 244, 246, 248, and 250 extend between extensions 76(*a*) in alignment with extensions 18(*a*) and 18(*b*).

In reference to FIG. 14, the roof truss expansion cap 204 further comprises, in effect, extensions of the secondary inclined upper chord member 18 of FIG. 1(*a*) and designated in FIG. 14 as 18(*a*), 18(*b*), 18(*c*) and 18(*d*). These extensions are also connected together by horizontal connecting members 232, 234, 236, and 238.

Figure 15:
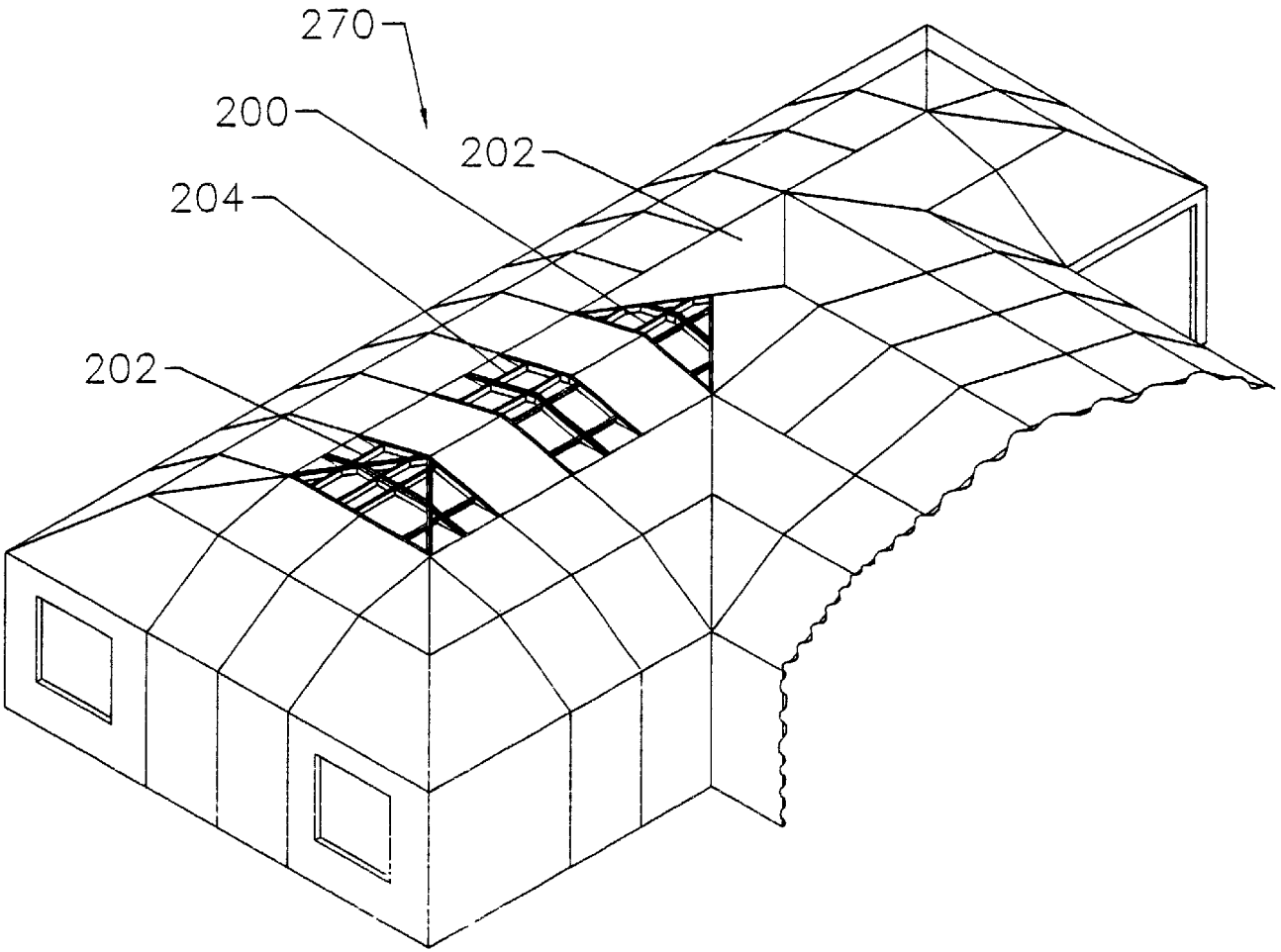
FIG. 15 is a partial view of one form of home that may be constructed, and illustrating where a roof truss joiner cap, a roof truss hip cap and a roof truss expansion cap may be positioned over flat truss section components (not illustrated in this drawing figure) to complete the pitch of the inclined roof truss sections.

In reference to FIG. 15, which illustrates a fractional portion of a home 270, the roof truss joiner cap 200, the roof truss hip cap 202 and the roof truss expansion cap 204 are shown installed in the inclined roof truss sections over the areas that have been extended in length or width by use of flat truss sections. The roof truss hip cap 202 and the roof truss expansion cap 204 are each designed to be positioned upon the flat upper surfaces of the flat truss section components 180 (FIGS. 8, 9) to complete the pitch of the roof. The roof truss joiner cap 200, on the other hand, is designed to be positioned upon either one of the inclined surfaces of the roof truss hip cap 202 or upon and between the inclined surfaces of two adjacent roof truss expansion caps 204. (See discussion later of FIGS. 24, 25 and 26.) In the latter case, for instance, the flat faces of the extensions 18(*a*) of the roof truss joiner cap 200 (see FIG. 12), as inclined at less than 90 degrees from the vertical plane, will be positioned against one of the vertical side surfaces of another roof truss expansion cap 202 that is facing at right angles to the first two mentioned roof truss expansion caps 204. As may be seen from FIG. 15, for example, a valley for rain runoff will be created upon each side of the roof truss joiner cap 200 where its triangular sides intersects with either the inclined surfaces of the roof truss hip cap 202 in FIG. 15, or the inclined surfaces of two roof truss expansion caps 204 (See discussion later of FIGS. 24, 25 and 26). The flat truss sections in these particular areas of the drawing are not shown to avoid confusion in illustration.

These different roof truss caps may be covered by appropriate panels, such as OSB panels mentioned previously.

General Discussion

As may be noted from FIGS. 10, 11 and 15, once the various components have been positioned, installed and connected in the manner shown in these drawing figures, then window and door openings may be made in the load-bearing vertical wall sections wherever needed, such as illustrated, either at the manufacturer's plant (which would be more preferable from the standpoint of ease of construction and economy, as mentioned previously) or at the building site(at the last minute option of the homeowners to-be).

The nature of the materials to be used in the construction or formation of the components described herein will determine how the various elements will be secured to each other to form, for example, the secondary rib 10 and the primary rib 12. When using wood, metal connector plates known in the art may be used at the different intersections of the elements making up these two ribs. Connector plates have nailing teeth that have been punched out of the plates so that they extend outwardly from the plane of the plates, and by use of hydraulic presses are caused to be embedded in the wooden structural members, usually on opposite sides of the wooden structural members, and sometimes only on one side of such structural members. Present day roof trusses are generally connected and constructed in this manner. This process is usually conducted at the manufacturing site because hydraulic presses at the building site are usually not practical or possible.

When a connection needs to be made at a building site, such as when the flat truss section components disclosed herein are connected to the ends of the components of the invention, nailing plates may be used, which are metal plates having holes therein for insertion of nails therethrough and into the wooden structural members to create a strong joint connection.

When using metal building materials, the parts assembled to form, for instance, the secondary ribs 10 and the primary ribs 12, may be welded, cast, or bolted together by the use of connecting plates, or structurally bent from one integral member, to mention only a few possibilities.

Other types of materials, such as plastics, composition materials, and the like, may require other methods known in the art to form these ribs, for example.

Figure 16A:
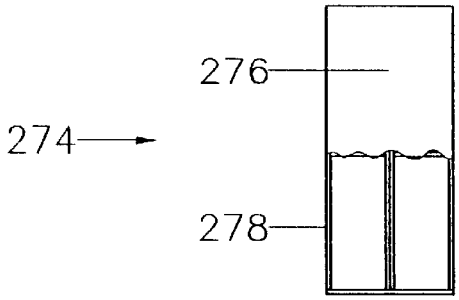
FIG. 16(*a*) is a front elevational view of a vertical wall section, showing the panel covering it being partially broken away to illustrate the supporting framework beneath the panel.
Figure 16B:
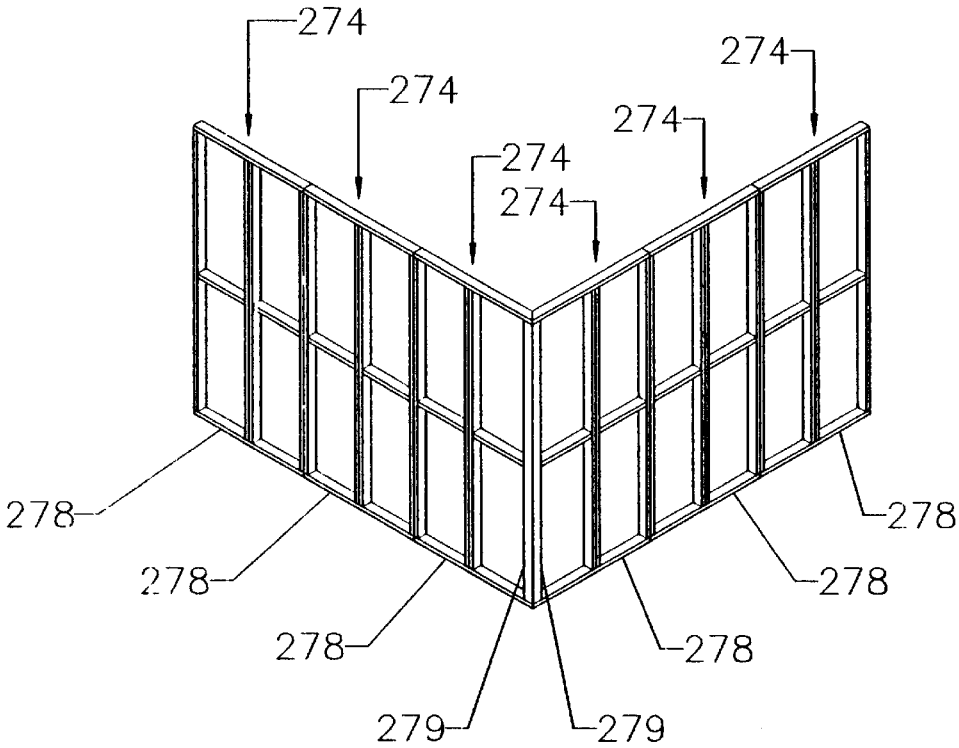

Although the homes illustrated thus far are shown as single story homes, multiple vertical wall sections 274, one vertical wall section being shown in FIG. 16(*a*), may be employed and joined together, as shown in part at FIG. 16(*b*), for the first story or first floor, with the components disclosed herein installed for the second story or second floor of a home, or even a third story or third floor, if that is what is wanted, with the vertical wall sections 274 filling in the space of the first floor beneath the components of the invention described herein. The vertical wall section 274 in FIG. 16(*a*) is shown with the panel or OSB panel 276 being partially removed to illustrate the supporting frame work 278 beneath the panel. The supporting framework 278 is shown more fully in FIG. 16(*b*).

In reference again to FIG. 16(*b*), the vertical members or studs 279 at the right angle intersection of the vertical wall sections 274 are each provided with a 45 degree bevel or miter on their narrow edges. In this manner when the vertical wall sections are assembled to form the completed right angle intersection, the two vertical members or studs 279 will present a right angle corner having flat faces to which appropriate panels may be secured. The beveled or mitered edges also enable the use of standard panels without also having to add for the width of the vertical members 279.

Modeling Blocks

The building system disclosed herein enables a potential purchaser of a home to readily design his/her/their own home, at least with respect to the general exterior appearance. Each of the components disclosed herein may initially be in the form of small modeling blocks, as previously mentioned, that may be arranged on a flat surface by the potential purchaser in a variety of ways.

Figure 17:
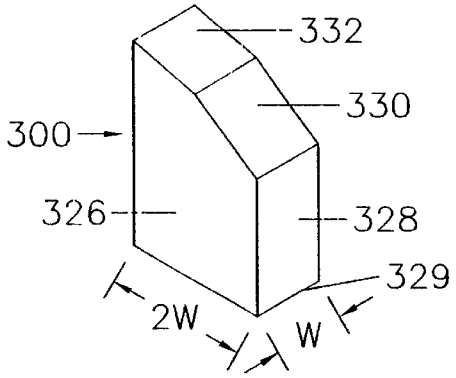
FIG. 17 is an isometric view of a modeling block representing an expansion section component disclosed in FIGS. 2(*a*), 2(*b*)

The different modeling blocks are shown in FIGS. 17 through 23(*a*), 23(*b*), wherein 300 in FIG. 17, for example, represents an expansion section component having a dual pitch inclined roof truss section. Obviously, if only a single pitch inclined roof truss section is needed, then modeling blocks employing only a single pitch inclined roof truss section would be used. Proportionately, the expansion section component block 300 represents a component having a width of W and a depth of 2W. In FIG. 17, the proportional W's may translate into a full-size component where W in actuality may equal 4 feet, for example, and 2W may equal 8 feet. The modeling block 300 has the configuration of a rectangular block having vertical sides 326, 328, which intersect the flat bottom surface 329 at right angles, and also at least one inclined top surface 330 intersecting the vertical sides 326, 328 at right angles. The recitation of "at least one inclined top surface" is intended to mean an inclined surface representing a component having a single pitch inclined roof truss section, but it also implies that the modeling block could also be configured to represent a component having a dual pitch inclined roof truss section, such as actually shown in FIG. 17, and thus there would be a second or another inclined surface 332, as shown.

Figure 18:
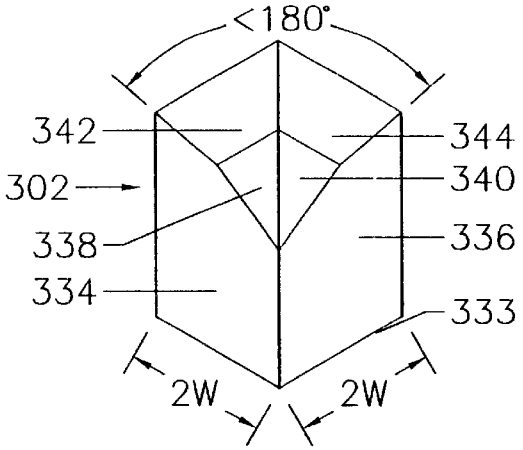
FIG. 18 is an isometric view of a modeling block representing an inside corner section component disclosed in FIGS. 3 and 4(*a*), 4(*b*)

302 in FIG. 18 is a modeling block representing an inside corner component. Proportionately, the inside corner component block 302 represents a component having a length on each side, as shown, of 2W. In FIG. 18, as is the case in FIG. 17, the proportional W's may translate into a full-size component where W may equal 4 feet and 2W may equal 8 feet. The modeling block 302 in FIG. 18 has the configuration of a rectangular block having a flat bottom surface 333, vertical sides 334, 336 intersecting the flat bottom surface at right angles, and at least one inclined top surface defined by two intersecting triangular plane surfaces 338, 340 having an angle therebetween less than 180 degrees, as measured from the top surface. As indicated above, the recitation of "at least one inclined top surface" is intended to mean a component that may have an inclined roof truss section that has a single pitch, but it also implies that the component may have an inclined roof truss section that has a dual pitch, and therefore, additional top surfaces 342, 344 along with triangular plane surfaces 338, 340 shown in FIG. 18 represent a dual pitch inclined roof truss section. The two intersecting triangular plane surfaces 338, 340 and 342, 344, also intersect the vertical sides at right angles.

Figure 19:
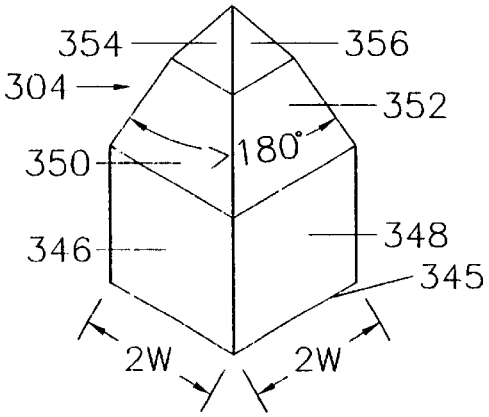
FIG. 19 is an isometric view of a modeling block representing an outside corner section component disclosed in FIGS. 5 and 6(*a*) 6(*b*)

304 in FIG. 19 is a modeling block representing an outside corner component. Proportionately, the outside corner component block 304 represents a component having a length on each side, as shown, of 2W. In FIG. 19, the proportional W's for the modeling block may translate in the same manner as described above with respect to FIGS. 17 and 18. The modeling block 304 has the configuration of a rectangular block having a flat bottom surface 345, vertical sides 346, 348 intersecting the flat bottom surface at right angles, and at least one inclined top surface defined by two intersecting triangular plane surfaces 350, 352 having an angle therebetween greater than 180 degrees, as measured from the top surface. The recitation of "at least one inclined top surface" equally applies here as applied with respect to FIGS. 17 and 18, and therefore, there will be additional inclined top surfaces for an inclined roof truss section having a dual pitch, as shown in FIG. 19 at 354, 356.

Figure 20:
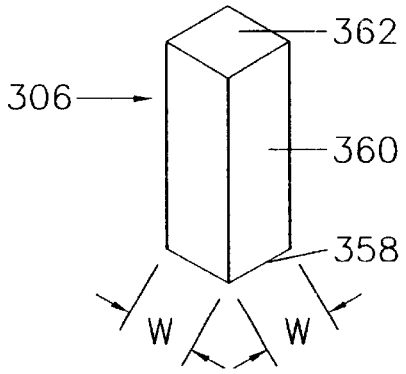
FIG. 20 is an isometric view of a modeling block representing a flat truss section component disclosed in FIGS. 8 and 9.

306 in FIG. 20 is a modeling block representing a flat truss section component. Proportionately, the flat truss section component block 306 represents a component having a length on each side, as shown, of W. It should be noted that this length may be varied in either direction, by the use of additional modeling blocks 306 or multiples of W so as to achieve, for instance the flat truss section component 180 shown in FIGS. 8, 9. The modeling block 306 has the configuration of a rectangular block having a flat bottom surface 358, vertical sides 360 intersecting the flat bottom surface at right angles, and a top flat surface 362 also intersecting the vertical sides at right angles.

The potential home buyer simply selectively arranges on a flat surface any number of these modeling blocks in whatever combination to see what the resulting exterior appearance of a home will be. The modeling blocks can be added to, or subtracted from, and re-arranged repeatedly for the potential home buyer to study and think about until he/she/they achieve a satisfying result that will lead to the construction of a full sized home.

Figure 21A:
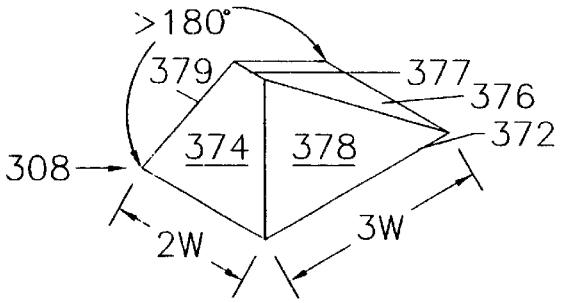
FIG. 21(*a*) is an isometric view of a modeling block representing a roof truss hip cap disclosed in FIG. 13.
Figure 21B:
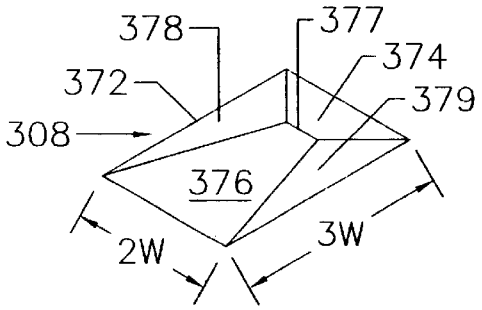
Figure 22:
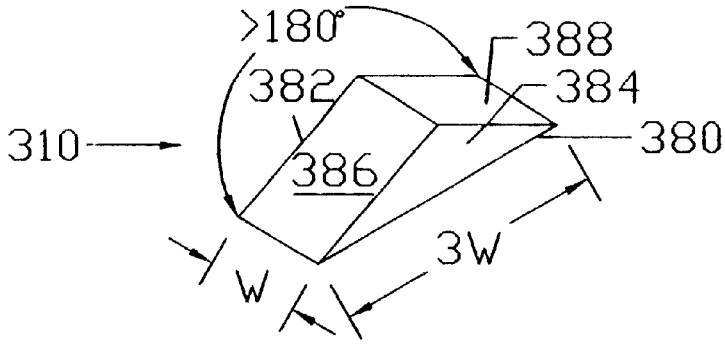
FIG. 22 is an isometric view of a modeling block representing a roof truss expansion cap disclosed in FIG. 14.
Figure 23A:
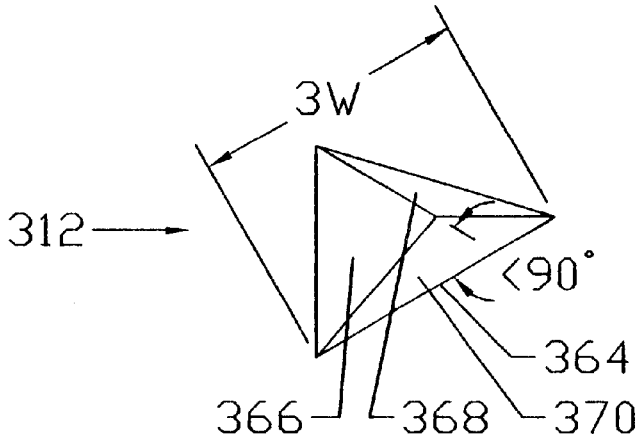
FIG. 23(*a*) is an isometric view of a modeling block representing a roof truss joiner cap disclosed in FIG. 12.
Figure 23B:
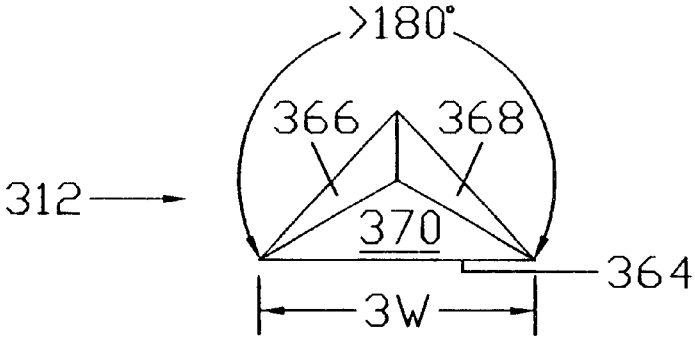

If the home designed by this modeling block system should be of a size requiring the use of flat truss section component modeling blocks 306 (FIG. 20), then the potential home buyer may position on the flat top surfaces of the flat truss section component modeling blocks the modeling blocks representing the various roof truss caps, such as roof truss hip cap modeling block 308 in FIGS. 21(*a*), 21(*b*), which is a modeling block representing the roof truss hip cap 202 of FIG. 13 and shown at 202 in position in FIG. 15; such as roof truss expansion cap modeling block 310 of FIG. 22, which is the modeling block representing the roof truss expansion cap 204 of FIG. 14 and shown at 204 in position in FIG. 15; and such as 312 in FIGS. 23(*a*) 23(*b*), which is a modeling block representing the roof truss joiner cap 200 of FIG. 12 and shown at 202 in position in FIG. 15.

In reference to FIGS. 21(*a*), 21(*b*), the roof truss hip cap modeling block 308 has a configuration of a rectangular block that has a flat bottom surface 372, a top surface intersecting the flat bottom surface and defined by two intersecting and oppositely facing truncated triangular plane surfaces 374, 376, each intersecting the other along the line of truncation 377 between the truncated triangular plane surfaces at an angle greater than 180 degrees, as measured from the top surface, and each also intersecting along one its three sides the flat bottom surface 372. The rectangular block further has a triangular plane surface 378 that is located between and intersects along each of two of its three sides another of the three sides of one of the truncated triangular plane surfaces and that also intersects along its third side the flat bottom surface 372. The rectangular block still further includes a triangular side surface 379 that intersects on one of its three sides the flat bottom surface 372 at right angles and intersects on each of its other two sides the third side of one of the truncated triangular plane surfaces 374, 376. The oppositely facing truncated triangular surfaces may have a length along one its three sides of 2W, and the triangular plane surface 378 may have a length along one its three sides of 3W. As previously indicated, these lengths may vary depending upon the size and number of the flat truss section component modeling blocks to be used, and will represent the actual sizes required for the full size components to be used in building a home.

In reference to FIG. 22, the roof truss expansion cap modeling block 312 has the configuration of a rectangular block having a flat bottom surface 380, and two triangular plane surfaces 382, 384, each intersecting at one of its three sides the flat bottom surface 380 at right angles. The rectangular block further has at least two inclined, oppositely facing rectangular flat surfaces 386, 388, each intersecting the other along one of its four sides at an angle greater than 180 degrees, as measured from the top surface. The two inclined rectangular flat surfaces 386, 388, each also intersects along one of two other of its sides one of the sides of each of the triangular plane surfaces 382, 384. Still another of its four sides intersects the flat bottom surface 380. As may be observed from FIG. 22 of the drawings, the length of the rectangular block along one side may be 3W and the length along another side may be W. These sizes may vary, again depending upon the size and number of flat truss section modeling blocks to be used to represent the actual size of the full size components to be used. in building a home.

In reference to FIGS. 23(*a*), 23(*b*), the roof truss joiner cap has the configuration of a triangular block having a flat bottom surface 364 and a top surface that is defined by two oppositely facing inclined triangular plane surfaces 366, 368, each intersecting the other along one of its three sides at greater than 180 degrees, as measured from the top surface, and intersecting along another of its three sides the flat bottom surface 364. The triangular block further has a flat triangular surface 370 that is inclined from a vertical plane of less than 90 degrees (as shown in FIG. 23(*a*)), that intersects along one of its three sides the flat bottom surface 364 and also intersects along each of its other two sides the third side of one of two oppositely facing inclined triangular plane surfaces 366, 368. The triangular block may have, for example, a length of 3W, as shown in the drawings, but this would depend upon the size of the structures upon which it should be positioned, such positioning to be described.

Figure 24:
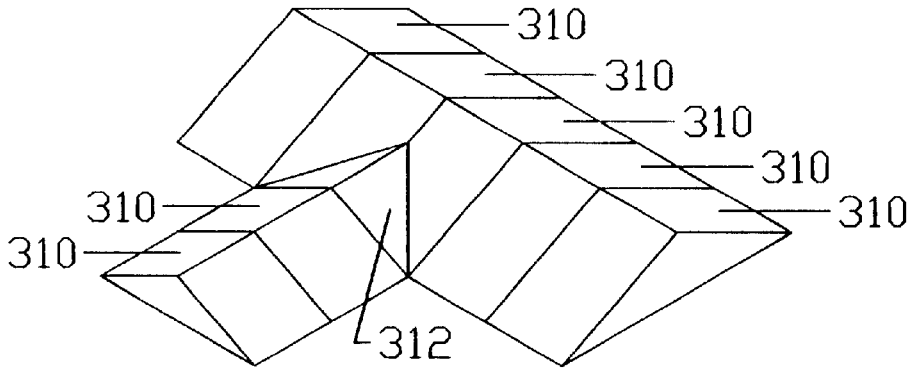
FIG. 24 is an isometric view illustrating the position of the roof truss joiner cap modeling block upon part of the array of roof truss expansion cap modeling blocks extending in one direction and between two roof truss expansion cap modeling blocks extending at right angles to the array.
Figure 25:
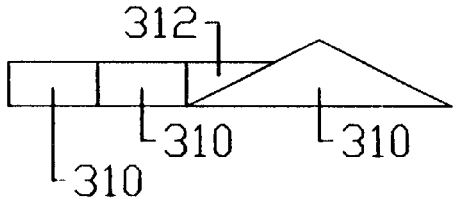
FIG. 25 is a side elevation view of the modeling blocks shown in FIG. 24 and illustrating the position of the roof truss joiner cap block upon part of the array of FIG. 24 and between the two roof truss expansion cap modeling blocks extending at right angles to the array.
Figure 26:
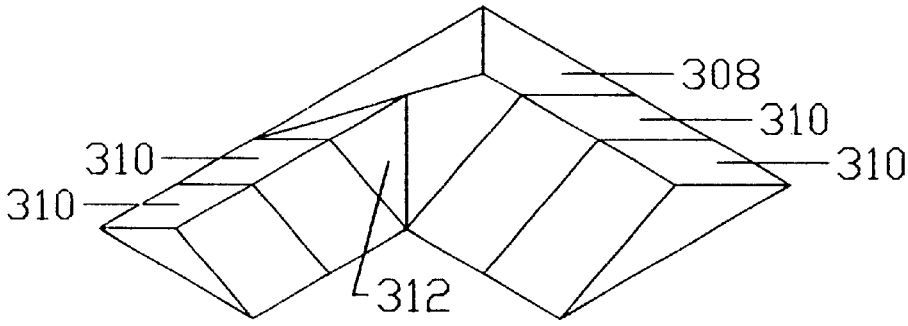
FIG. 26 is an isometric view illustrating the position of the roof truss joiner cap modeling block upon one of the truncated surfaces of the roof truss hip cap modeling block, which extends in one direction and between the roof truss expansion cap modeling blocks, which extend at right angles to the roof truss hip cap and the two adjoining roof truss expansion cap modeling blocks.

To understand the function of the roof truss joiner cap, as shown at 200 in FIG. 15 and as shown as a roof truss joiner cap modeling block at 312 in FIGS. 23(*a*), 23(*b*), reference is made to FIGS. 24, 25 and 26. In FIG. 24, an array (five, for example) of roof truss expansion cap modeling blocks 310 is shown extending in one direction, and two other roof truss expansion cap modeling blocks 310 are shown extending at right angles to the aforementioned array. A roof truss joiner cap modeling block 312 is positioned between the array and the two other roof truss expansion cap modeling blocks 310 to make a smooth transition therebetween and create a valley for rain run-off on each side of the roof truss joiner cap modeling block where its flat bottom surface is positioned upon the inclined rectangular flat surfaces of the roof truss expansion cap blocks 310 in the array.

In reference to FIG. 25, it may be observed that when the flat bottom surface of the roof truss joiner cap modeling block 312 is positioned upon the roof truss expansion cap modeling blocks 310 of the array of FIG. 24, the flat triangular surface of the truss joiner cap modeling block, which is inclined from a vertical plane of less than 90 degrees, will fit squarely against one of the flat triangular sides (382, 384, as shown in FIG. 22) of one of the two roof truss expansion cap modeling blocks shown to the left of the array.

In reference to FIG. 26, this drawing figure illustrates how the flat bottom surface of the roof truss joiner cap modeling block 312 is adapted to be positioned upon one of the two inclined, truncated triangular sides (374, 376,as shown in FIG. 21(*a*), 21(*b*)) so as to make the transition between the roof truss hip cap modeling block 308 extending in one direction on one side and the roof truss expansion cap modeling blocks 310 that intersect at right angles with the roof truss hip cap modeling block 308 and extend in another direction. A valley for rain run-off is created upon each side of the roof truss joiner cap modeling block 312 adjacent where its flat bottom surface is positioned upon one of the inclined, truncated triangular surfaces of the roof truss hip cap modeling block 308. This latter-mentioned result is also shown in FIG. 15 where the roof truss joiner cap 200 is shown in position against the roof truss hip cap 202 (shown at the upper right in the drawings and covered by a panel such as an OSB panel).

Figure 27:
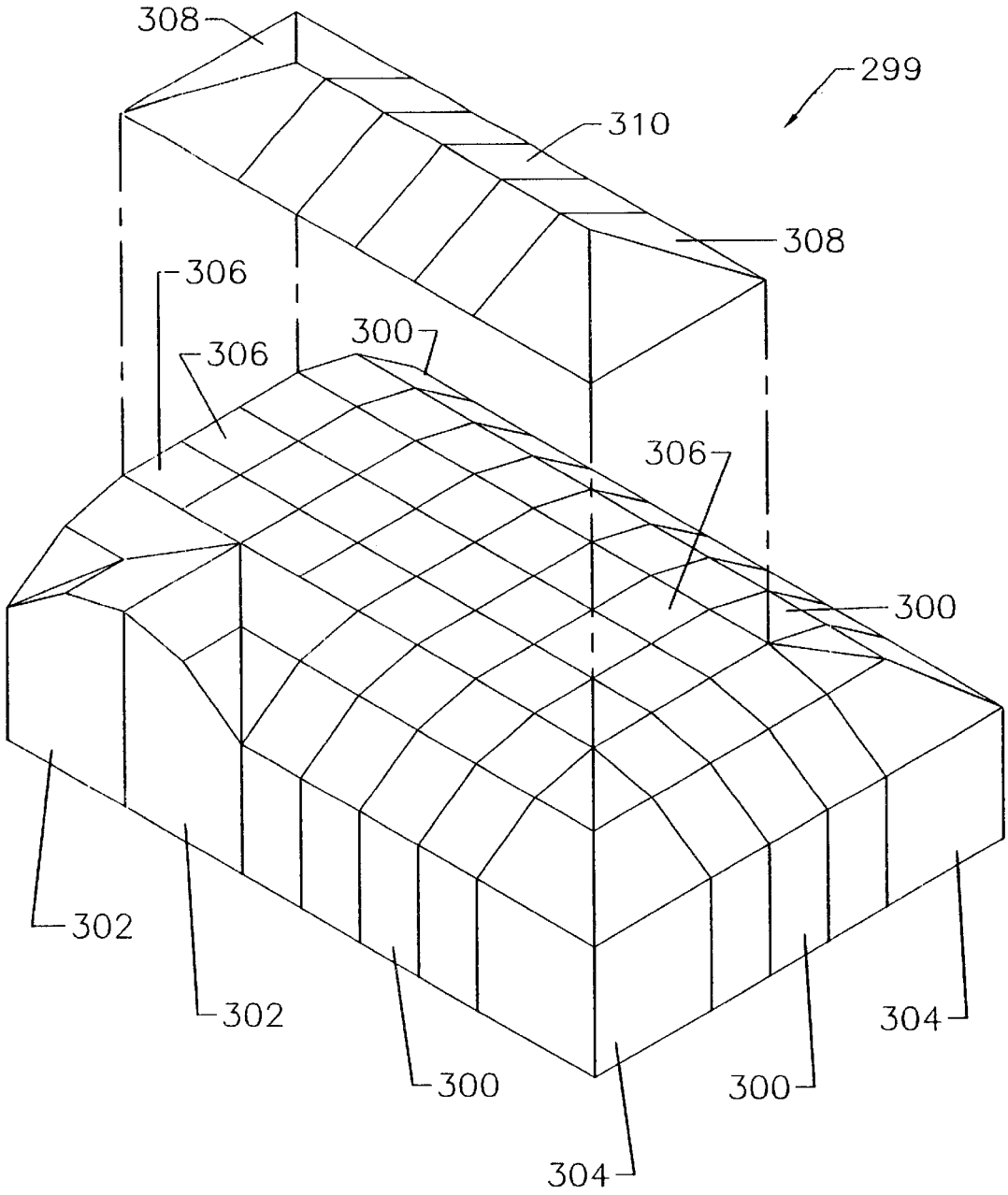
FIG. 27 is an isometric view of one form of a model home that may be selectively arranged together by the potential home owner by the various modeling blocks disclosed herein, and illustrating in partial exploded view the modeling blocks for the different roof caps and showing the modeling blocks representing the flat truss section components in position below above and over which the roof cap modeling blocks are to be installed.

In reference to FIG. 27, this represents the exterior appearance of one form of home 299 that may be formed by the modeling blocks described herein by a potential home buyer. The roof truss cap modeling blocks are shown in exploded or raised condition above the home to show the multiple flat truss section modeling blocks 306 upon which the roof truss cap modeling blocks will be positioned.

Draw Files

In reference to FIGS. 28 through 33, these drawing figures represent "draw files" of the different components that have been described thus far, with the exception of the flat truss section component (for a reason that will be discussed later). The "draw files" are filed in a computer system, which may be maintained by a building contractor, by Lowe's, for example, and by Home Depot, for another example, and the like, so that when a would-be homeowner wishes to see the results of different arrangements of the components of the invention, these "draw files" may be retrieved from the computer system, selectively arranged and assembled together on the screen of a monitor, as by use of a computer mouse. The use of these "draw files" may serve as an alternative to the use of modeling blocks.

Figure 28:
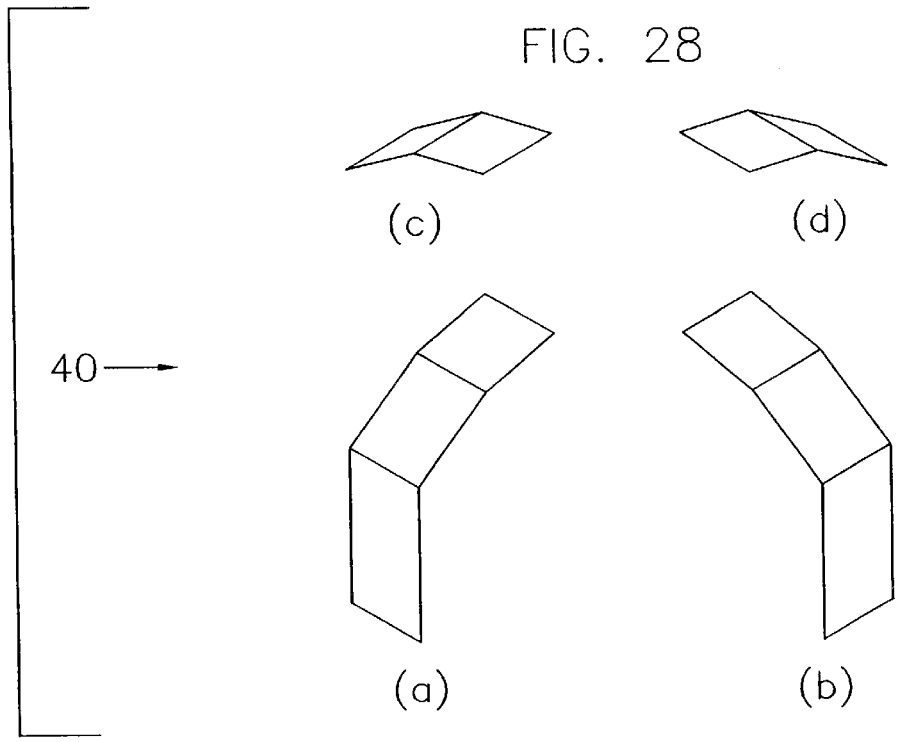

FIG. 28 shows four different orientations representing the dual pitch expansion section 40 of FIGS. 2(*a*), 2(*b*). Obviously, "draw files" may also be used wherein the components may have a single pitch roof or any other pitch or combination of pitches for a roof.

In FIG. 28, for example, the two lower "draw files," FIG. 28(*a*), FIG. 28(*b*), show a complete configuration of an expansion section component, that is, the vertical wall section is represented and the inclined roof truss section is represented, while FIG. 28(*c*), FIG. 28(*d*) only show the representation of the inclined roof truss section. The reason for this is that some of the expansion components will appear in the front of the home where the whole configuration will show while others appear in the rear of the home where only the inclined roof truss section representation will be seen because the vertical wall section representation will be obscured by the other components located in front of the inclined roof truss section representations. For instance, the configurations shown by FIG. 28(*a*), FIG. 28(*b*) and FIG. 28(*c*) appear in several different locations in the home shown at 170 in FIG. 7. If the would-be homeowner wishes to see on the monitor screen the opposite side of the home, then the "draw files" can be retrieved accordingly to show such opposite side.

Figure 29:
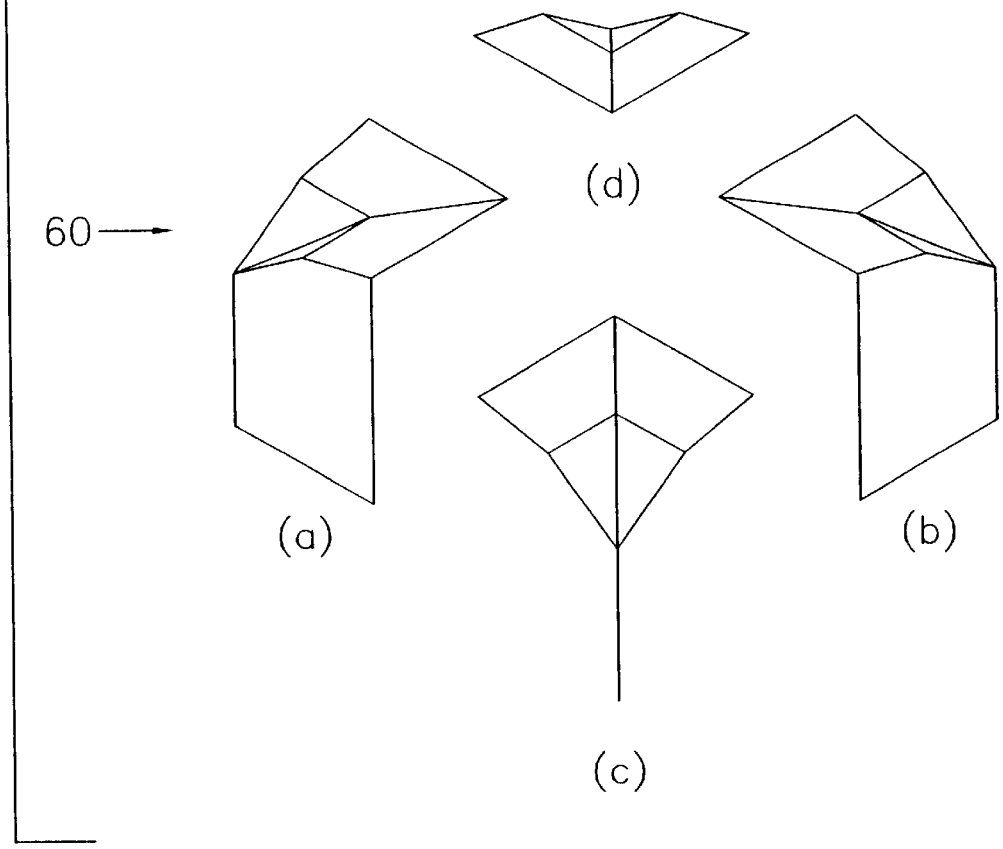

FIG. 29 show four different orientations for the dual pitch inside corner component 60 of FIGS. 4(*a*), 4(*b*). As previously noted, the "draw files" may also include components having single pitch inclined roof truss sections or any other combination of pitches. In the home shown at 176 in FIGS. 10 and 11, there is at least two representations in each figure of the "draw file" shown in FIG. 29(*c*) and at least one representation of the "draw file" shown in FIG. 29(*d*), for example.

Figure 30:
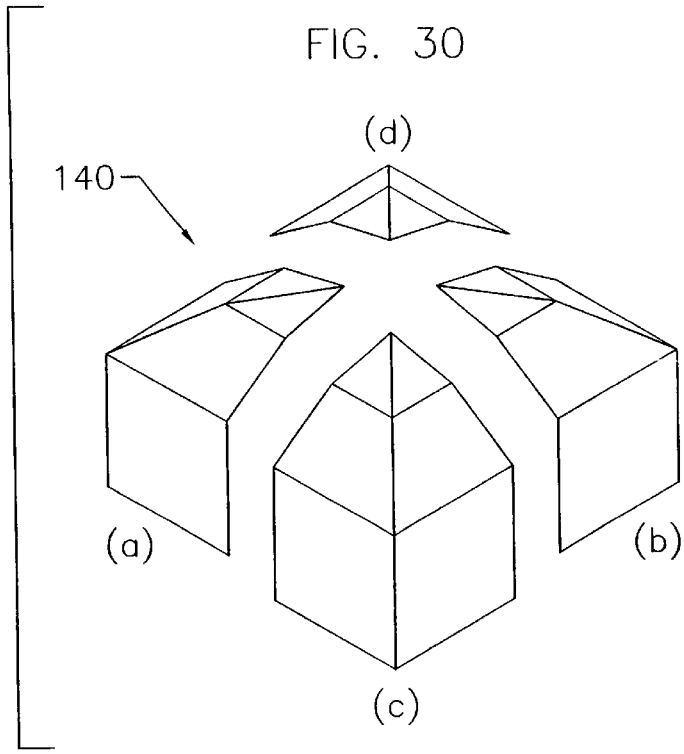

FIG. 30 shows four different orientations for the dual pitch outside corner component 140. In the home shown at 299 in FIG. 27, for example, the "draw files" of FIG. 30(*b*) and FIG. 30(*c*) are each used at least once.

Figure 31:
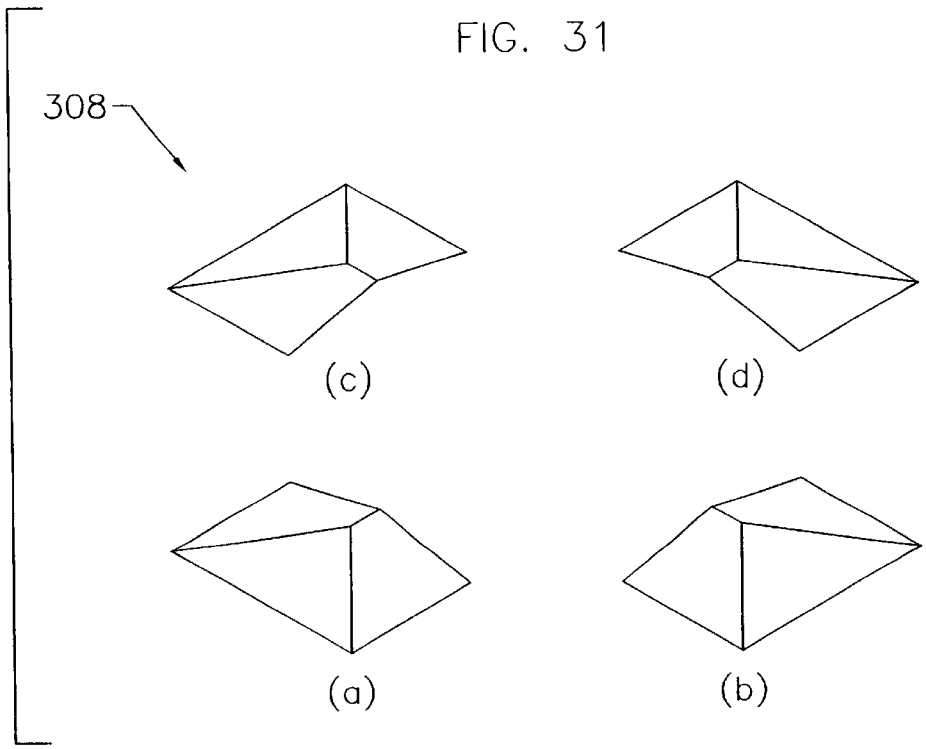

FIG. 31 shows four different orientations for the roof truss hip cap of FIGS. 21(*a*), 21(*b*), for instance. Depending upon where on the monitor screen the particular representation of the roof truss hip cap is to appear, will determine which "draw file," either (*a*), (*b*), (*c*), or (*d*), will be used. In the home shown at 299 in FIG. 27, the "draw files" of 31(*b*) and 31(*c*) are used for the roof caps in the exploded view.

Figure 32:
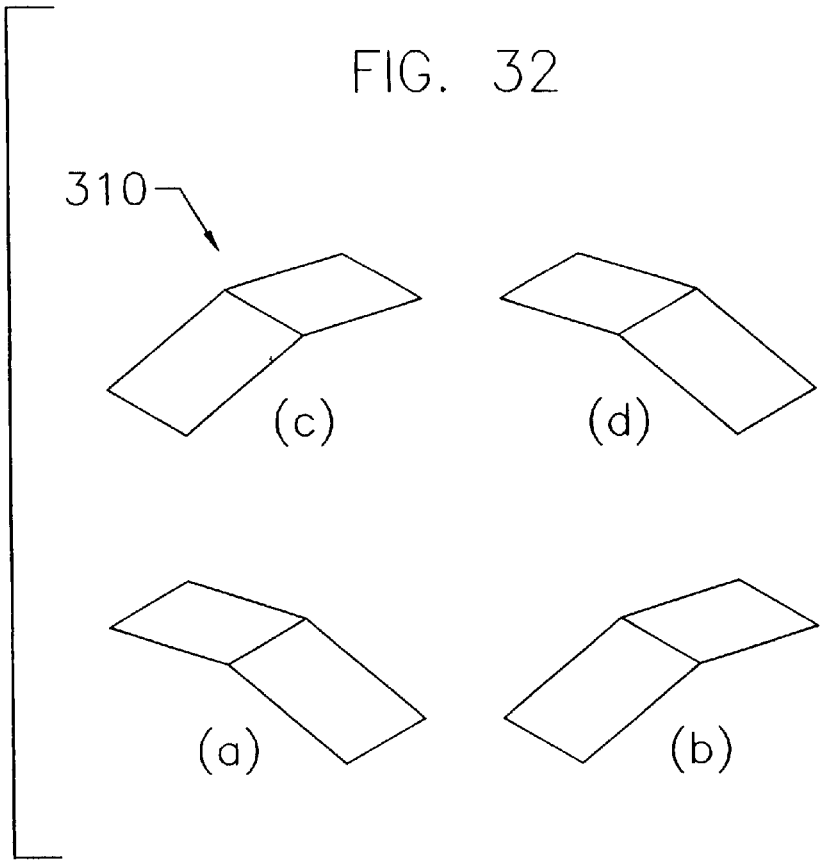

FIG. 32 shows four orientations for the roof truss expansion cap, such as shown at 312 in FIG. 22. Although four orientations have been shown for purpose of being consistent in showing four orientations each for the other components, due to the particular design of the roof truss expansion cap 312, only FIG. 32(*a*) and FIG. 32(*b*) are different, while FIG. 32(*c*) and FIG. 32(*d*) are the same, respectively, for FIG. 32(*b*) and FIG. 32(*a*). Examples of the appearance of the "draw files" for FIG. 32(*a*) and FIG. 32(*b*), for instance, can be seen in FIG. 15. See also FIG. 27 where the "draw file" of FIG. 32(*b*) can be seen.

Figure 33:
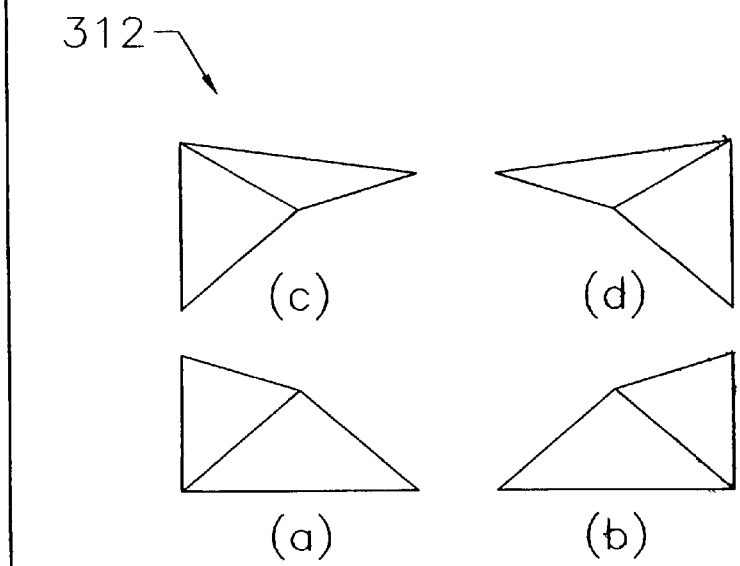

FIG. 33 shows four different orientations: (*a*), (*b*), (*c*) and (*d*), for representing the roof truss joiner cap 312 of FIGS. 23(*a*), 23(*b*). See, for example, FIGS. 24, 26 where FIG. 33(*d*) is shown on a smaller scale than that shown in FIG. 33(*d*).

It should be noted here that "draw files" for the flat roof truss section 180 of FIGS. 8 and 9 are not required because the space that they would occupy on a monitor screen would be covered by one of the other "draw files" described above.

Once the potential home buyers have decided upon the general exterior appearance of a home, then the building contractor, for instance, simply orders the number of components needed. When these components are delivered at the building site, assuming, of course, that the flat surface has been previously prepared, the building contractor arranges the components in accordance with the wishes of the homeowner to-be, then assembles and secures same together on the previously prepared flat surface. The components, when assembled in position are self-aligning. The nature of the disclosed building system of the invention is such that the system has already been engineered beforehand in the construction of the components so that there is no need for whoever constructs a home in the manner disclosed to have any engineering or architectural experience. The potential home purchaser becomes in effect his/her/their own engineer and architect in arranging the modeling blocks disclosed herein to achieve the design appearance desired. The home, once the flat supporting surface is established beforehand, can be under roof in a day, and especially so if the components already are covered with panels when the components are delivered to the building site.

Conclusion

The invention has been described in detail with particular reference to preferred embodiments thereof, but it will be understood that variations and modifications can be effected within the spirit and scope of the invention.

I claim:

1. A componentized three dimensional, self-aligning, self-engineering building system for homes and similar constructions and comprising:

a plurality of individual, separately installable, preassembled components each having a predetermined width and the same predetermined height adapted to be selectively arranged, positioned and secured to each other in side-by-side relationship along the perimeter of and also secured on a previously prepared flat supporting surface for each of said homes and similar constructions;

each component defining at least one load-bearing vertical wall section having a lower end adapted to engage and to be secured to said flat supporting surface, and an upper end; and an inclined roof truss section and having a lower end joined to said upper end of said vertical wall section and having an upper end, and defining on each side of at least two sides of said inclined roof truss section a plane of intersection with the inclined roof truss section of an adjacent installable component;

each component comprising a left rib and a right rib connected together in parallel relationship, said left rib and said right rib each comprising a primary vertical member included in said load-bearing vertical wall section and having a predetermined length, and having a lower end adapted to engage said flat supporting surface, and having an upper end; and a primary inclined lower chord member having a predetermined length and a primary inclined upper chord member having a predetermined length and overlying the primary inclined lower chord member in paired relationship;

said primary inclined lower chord member and said primary inclined upper chord member being connected together at their respective lower ends to said upper end of said primary vertical member, and means spaced from said respective lower ends of said primary inclined lower chord member and said primary inclined upper chord member and connecting together said primary inclined lower chord member and said primary inclined upper chord member in spaced apart relationship and defining in part with said primary inclined lower chord member and said primary inclined upper chord member a series of multiple polygon configurated reinforcements in said inclined roof truss section;

said left rib and said right rib each includes connected thereto at least three trusses, each truss having a secondary inclined lower chord member having a predetermined length and a secondary inclined upper chord member having a predetermined length and overlying said secondary inclined lower chord member in paired relationship; said secondary inclined lower chord member and said secondary inclined upper chord member each having a lower end and an upper end and being connected at their respective lower ends, respectively, to and spaced at intervals parallel to each other along and inclined outwardly from said primary inclined lower chord member and said primary inclined upper chord member, and a first means spaced from said respective ends and connecting said secondary inclined lower chord member and said secondary inclined upper chord member in spaced apart relationship and defining in part with said secondary inclined lower chord member and said secondary inclined upper chord member said series of multiple polygon configurated reinforcements; and a second means connecting together said at least three trusses in spaced parallel side-by-side relationships to form with said load-bearing vertical wall section said component.

2. A componentized three dimensional self-aligning, self-engineering building system as defined in claim 1, and wherein said one of said plurality of components has an inclined roof truss section defined by two three-sided planes each intersecting the other along a corresponding side thereof at an angle less than 180 degress, as measured from the upper side of the inclined roof truss section.

3. A componentized three dimensional self-aligning, self-engineering building system as defined in claim 1, and wherein said one of said plurality of components has an inclined roof truss section defined by two three-sided planes each intersecting the other along a corresponding side thereof at an angle greater than 180 degress, as measured from the upper side of the inclined roof truss section.

4. A componentized three dimensional, self-aligning, self-engineering building system as defined in claim 1, and wherein each said secondary inclined lower chord member and its overlying secondary inclined upper chord member in said parallel relationships of said left rib and said right rib have different predetermined lengths than adjacent secondary inclined lower chord members and secondary inclined upper chord members.

5. A componentized three dimensional self-aligning, self-engineering building system as defined in claim 1, and wherein said left rib and said right rib each includes at spaced parallel intervals therefrom a plurality of secondary vertical members of said load-bearing vertical wall section having the same predetermined lengths and each having a lower end adapted to engage said flat supporting surface, and an upper end; said secondary inclined lower chord members and said secondary inclined upper chord members being connected, respectively, at their lower ends to a respective upper end of a secondary vertical member.

6. A componentized three dimensional, self-aligning, self-engineering building system as defined in claim 5, and further including flat truss section components each comprising pairs of horizontally extending lower chord members and horizontally extending upper chord members each overlying one of said horizontally extending lower chord members in spaced parallel relationship, and each said pair of horizontally extending lower chord members and horizontally extending upper chord members being connected together in side-by-side relationship to define a rectangular cross-section having a predetermined width and a predetermined length longer than said predetermined width;

each horizontally extending lower chord member and its overlying horizontally extending upper chord member of said pair having connected therebetween a series of reinforcing members formed in multiple polygon configurations, each flat truss section component including at each end a pair of end members connected, respectively, across the respective lower ends and upper ends of each pair of horizontally extending lower chord members and horizontally extending upper chord members in said flat truss section component; and the respective end members for said horizontally extending lower chord members and horizontally extending upper chord members being connected, respectively, to said upper ends of said secondary inclined lower chord members and said secondary inclined upper chord members of said inclined roof truss section.

7. A componentized three dimensional, self-aligning, self-engineering building system as defined in claim 1, and further including flat truss section components each comprising pairs of horizontally extending lower chord members and horizontally extending upper chord members each overlying one of said horizontally extending lower chord members in spaced parallel relationship, and each said pair of horizontally extending lower chord members and horizontally extending upper chord members being connected together in side-by-side relationship to define a rectangular cross-section having a predetermined width and a predetermined length longer than said predetermined width;

each horizontally extending lower chord member and its overlying horizontally extending upper chord member of said pair having connected therebetween a series of reinforcing members formed in multiple polygon configurations, each flat truss section component including at each end a pair of end members connected, respectively, across the respective lower ends and upper ends of each pair of horizontally extending lower chord members and horizontally extending upper chord members in said flat truss section component; and each flat truss section component being adapted to engage at each pair of said end members and be connected to an inclined roof truss section of another of said components.

8. A componentized three dimensional, self-aligning, self-engineering building system as defined in claim 1, and further including flat truss section components each comprising pairs of horizontally extending lower chord members and horizontally extending upper chord members each overlying one of said horizontally extending lower chord members in spaced parallel relationship and being connected together in side-by-side spaced, parallel relationship to define a rectangular cross-section having a predetermined width and a predetermined length longer than said predetermined width;

each horizontally extending lower chord member and the overlying horizontally extending upper chord member having connected therebetween a series of reinforcing members formed in multiple polygon configurations, the horizontally extending lower chord member and its overlying horizontally extending upper chord member that are located on each of two sides of the flat truss section component define a pair of side members adapted to engage and be connected to another of said components.

9. A componentized three dimensional, self-aligning, self-engineering building system as defined in claim 1, and wherein said first means includes at the upper ends of and connected to and between each of said secondary inclined lower chord members and said secondary inclined upper chord members a first vertically disposed end base connecting segment having a predetermined length, at least a second vertically disposed end base connecting segment having a predetermined length and connected between and intermediate of said predetermined lengths of said secondary inclined lower chord member and said secondary inclined upper chord member, and a connecting segment having a predetermined length and connected to and extending diagonally from one end portion of said first vertically disposed end base connecting segment to and connected thereto an end portion of said second vertically disposed end base connecting segment; said first end base connecting segment, said second end base connecting segment and said diagonally extending connecting segment defining in part with said secondary inclined lower chord member and its overlying secondary inclined upper chord member said series of multiple polygon configurated reinforcements in said inclined roof truss section.

10. A componentized three dimensional, self-aligning, self-engineering building system as defined in claim 9, and further including flat truss section components each comprising pairs of horizontally extending lower chord members and horizontally extending upper chord members each overlying one of said horizontally extending lower chord members in spaced parallel relationship, and each pair of horizontally extending lower chord members and horizontally extending upper chord members being connected together in side-by-side spaced, parallel relationship to define a rectangular cross-section having a predetermined width and a predetermined length great than said predetermined width;

each horizontally extending lower chord member and its overlying horizontally extending upper chord member of said pair having connected therebetween a series of reinforcing members formed in multiple polygon configurations, each flat truss section component including at each end a pair of end members connected, respectively, across the respective lower ends and upper ends of each pair of horizontally extending lower chord members and horizontally extending upper chord members in said flat truss section component; and the respective end members for said horizontally extending lower chord members and horizontally extending upper chord members being connected, respectively, to said upper ends of said secondary inclined lower chord members and said secondary inclined upper chord members of said inclined roof truss section.

11. A componentized three dimensional, self-aligning, self-engineering building system for homes and similar constructions and comprising:

a plurality of individual, separately installable components having a predetermined width and having the same predetermined height selectively arranged, positioned and secured to each other in side-by-side relationship along the perimeter of and also secured on a previously prepared flat supporting surface for each of said homes and similar constructions;

each component defining at least one load-bearing vertical wall section having a lower end adapted to engage and to be secured to said flat supporting surface, and an upper end; and an inclined roof truss section comprising a series of multiple polygon configurated reinforcements connected together in side-by-side relationships, said inclined roof truss section having a lower end joined to said upper end of said vertical wall section to form an integrally constructed connected unit, and having an upper end, and defines on each side a plane of intersection with the inclined roof truss section of an adjacent component;

and further comprising modeling blocks representing said components and including the following basic block shapes:

a. a rectangular block having a predetermined width and a predetermined length greater than said predetermined width, a flat bottom surface, vertical sides intersecting the flat bottom surface at right-angles, and at least one inclined top surface intersecting the vertical sides at right angles;

b. a rectangular block having the same predetermined length on each side, a flat bottom surface, vertical sides intersecting the flat bottom surface at right angles, at least one inclined top surface defined by two intersecting triangular plane surfaces having an angle therebetween less than 180 degrees, as measured from the top surface, and said two intersecting triangular planes surfaces also intersecting the vertical sides at right angles; and c. a rectangular block having the same predetermined length on each side, a flat bottom surface, vertical sides intersecting the flat bottom surface at right angles, at least one inclined top surface defined by two intersecting triangular plane surfaces having an angle therebetween greater than 180 degrees, as measured from the top surface, and said two intersecting triangular plane surfaces also intersecting the vertical sides at right angles.

12. A componentized three dimensional, self-aligning, self-engineering building system for homes and similar constructions and comprising:

a plurality of individual, separately installable components having a predetermined width and having the same predetermined height selectively arranged, positioned and secured to each other in side-by-side relationship along the perimeter of and also secured on a previously prepared flat supporting surface for each of said homes and similar constructions;

each component defining at least one load-bearing vertical wall section having a lower end adapted to engage and to be secured to said flat supporting surface, and an upper end; and an inclined roof truss section comprising a series of multiple polygon configurated reinforcements connected together in side-by-side relationships, said inclined roof truss section having a lower end joined to said upper end of said vertical wall section to form an integrally constructed connected unit, and having an upper end, and defines on each side a plane of intersection with the inclined roof truss section of an adjacent component; and further including flat truss section components each comprising pairs of horizontally extending lower chord members and horizontally extending upper chord members each overlying one of said horizontally extending lower chord members in spaced parallel relationship, and each said pair of horizontally extending lower chord members and horizontally extending upper chord members being connected together in side-by-side relationship to define a rectangular cross-section having a predetermined width and a predetermined length longer than said predetermined width;

each horizontally extending lower chord member and its overlying horizontally extending upper chord member of said pair having connected therebetween a series of reinforcing members formed in multiple polygon configurations, each flat truss section component including at each end a pair of end members connected, respectively, across the respective lower ends and upper ends of each pair of horizontally extending lower chord members and horizontally extending upper chord members in said flat truss section component;

each flat truss section component being adapted to engage at each pair of said end members and be connected to an inclined roof truss section of another of said components; and further comprising modeling blocks representing said components and including the following basic block shapes:

a. a rectangular block having the same predetermined length on each side, a flat bottom surface, vertical sides intersecting said flat bottom surface at right angles, a top flat surface intersecting said vertical sides at right angles;

b. a rectangular block having a predetermined length and a predetermined width, a flat bottom surface adapted to be positioned on said flat top surface of the rectangular block recited in subparagraph a., a top surface intersecting said flat bottom surface and defined by two intersecting and oppositely facing truncated triangular plane surfaces each intersecting the other along the line of truncation between said truncated plane surfaces at an angle greater than 180 degrees, as measured from the top surface, and each also intersecting along one of its three sides said flat bottom surface, a triangular plane surface located between and intersecting along each of two of its sides another of said three sides of one of said truncated triangular plane surfaces and also intersecting along its third side said flat bottom surface; said rectangular block further including a triangular side surface intersecting on one of its three sides said flat bottom surface at right angles and intersecting on each of the other two sides the third side of one of said truncated triangular plane surfaces;

c. a rectangular block having a predetermined length and a predetermined width, a flat bottom surface adapted to be positioned on said flat top surface of the rectangular block recited in subparagraph a., two triangular sides each intersecting at-one of its three sides said flat bottom surface at right angles, at least two inclined, oppositely facing rectangular flat surface each intersecting the other along one of its four sides at an angle greater than 180 degrees, as measured from the top surfaces, said two inclined rectangular flat surfaces each also intersecting along one of two other of its sides one of said triangular sides and along still another of its sides said flat bottom surface; and d. a triangular block having a predetermined length and a predetermined width, a flat bottom surface adapted to be positioned on one of said truncated triangular plane surfaces of the rectangular block recited in subparagraph b. and on one of said inclined rectangular flat surfaces of the rectangular block recited in subparagraph c., a top surface defined by two oppositely facing inclined triangular plane surfaces each intersecting the other along one of its three sides at greater than 180 degrees, as measured from the top surface, a flat triangular surface inclined from a vertical plane of less than 90 degrees and intersecting along one of its three sides said flat bottom surface and intersecting along each of two of its other sides one side of one of said two oppositely facing inclined triangular plane surfaces.

* * * * *